US005546734A

United States Patent [19]

Moncrief et al.

[11] Patent Number: 5,546,734

[45] Date of Patent: Aug. 20, 1996

[54] PACKAGING MACHINE AND METHOD OF PACKAGING ARTICLES

[75] Inventors: Frank Moncrief, Acworth, Ga.; Kelly W. Ziegler, Crosby, Minn.; Michael Hiney, Atlanta; Dennis Grimm, Marietta, both of Ga.

[73] Assignee: Riverhood International Corporation, Atlanta, Ga.

[21] Appl. No.: 118,111

[22] Filed: Sep. 2, 1993

[51] Int. Cl.[6] ..... B65B 35/30

[52] U.S. Cl. ..... 53/534; 53/251; 53/543; 53/566; 198/731; 198/836.3; 198/433

[58] Field of Search ..... 53/250, 251, 252, 53/257, 48.7, 443, 448, 458, 534, 543, 566; 198/418.1, 418.2, 426, 431, 432, 433, 419.3, 699, 731, 836.3

[56] References Cited

U.S. PATENT DOCUMENTS

| | | | |
|---|---|---|---|
| 2,102,569 | 12/1937 | Johnson | 197/731 |
| 2,756,553 | 7/1956 | Ferguson et al. | 53/251 X |
| 2,756,868 | 7/1956 | Russell | 198/731 |
| 2,951,574 | 9/1960 | Craig | 198/836.3 |
| 3,194,382 | 7/1965 | Nigrelli et al. | 198/418.1 |
| 3,554,353 | 1/1971 | Raudat | 198/836.3 |
| 3,559,796 | 2/1971 | Marks et al. | 198/731 X |
| 3,760,935 | 9/1973 | Ziegelmeyer | 198/731 |
| 3,778,959 | 12/1973 | Langen et al. . | |
| 3,842,570 | 10/1974 | Monaghan | 53/448 X |
| 4,237,673 | 12/1980 | Calvert et al. . | |
| 4,566,248 | 1/1986 | Cooley | 53/543 X |
| 4,642,967 | 2/1987 | Culpepper | 53/543 X |
| 4,642,975 | 2/1987 | Langen et al. | 198/836.3 X |
| 4,685,275 | 8/1987 | Nigrelli | 53/566 X |
| 4,693,055 | 9/1987 | Olsen Jr. et al. | 53/443 |
| 4,880,104 | 11/1989 | Evans et al. | 198/836.3 X |
| 4,887,414 | 12/1989 | Arena | 53/543 |
| 4,936,077 | 6/1990 | Langden et al. | 53/543 |
| 4,982,551 | 1/1991 | Nigrelli | 53/251 X |
| 4,982,835 | 1/1991 | Butler et al. | 198/836.5 |
| 5,036,644 | 8/1991 | Lashyro et al. | 53/448 X |
| 5,237,795 | 8/1993 | Cheney et al. | 53/251 X |
| 5,241,806 | 9/1993 | Ziegler et al. | 53/566 |
| 5,339,599 | 8/1994 | Rishes | 53/252 |

FOREIGN PATENT DOCUMENTS

| | | | |
|---|---|---|---|
| 552981 | 7/1993 | European Pat. Off. | 53/543 |

OTHER PUBLICATIONS

"The Can Targeteer," Manville Forest Products Corporation, West Monroe, Louisiana.

"The Targeteer–High Speed," Manville Forest Products Corporation, West Monroe, Louisiana.

"Charger," Riverwood International USA, Inc., Atlanta, Georgia.

"The Cavalier 8000," Manville Forest Products Corporation, West Monroe, Louisiana.

"Quikflex 1000," Riverwood International Corporation, Atlanta, Georgia.

*Primary Examiner*—John Sipos
*Assistant Examiner*—Daniel Moon
*Attorney, Agent, or Firm*—Hopkins & Thomas

[57] ABSTRACT

A continuous motion, end loading packaging machine forms article groups of a predetermined number and configuration using a flight type article selector. The packaging machine is flexible in its ability to package articles of different heights and diameters in various product configurations. The packaging machine includes adjustable guide rails to selectively change product infeed lane widths. The machine also phase adjusts the selector flights, and allows for easy selector flight replacement.

30 Claims, 13 Drawing Sheets

PACKAGING MACHINE AND METHOD OF PACKAGING ARTICLES

FIELD OF THE INVENTION

This invention relates to packaging machines and to methods of packaging articles into containers. More particularly, this invention concerns continuous motion, end loading packaging machines which form article groups of a predetermined number and configuration using a flight-type article selector, and direct the article group into a container, such as a preformed carton or package constructed of paperboard.

BACKGROUND OF THE INVENTION

Various types of packaging machines or cartoning apparatus are designed to package articles, such as bottles or cans, into a unitary container such as a paperboard carton. Although the ultimate intended goal of these types of packaging machinery is the same, that is to package a desired number of articles in a specific orientation, the methods and apparatus for accomplishing this goal are diverse. Typically, the articles are grouped in some manner to correspond with the approximate container dimensions, and the article group is then transferred into the container. As a final processing step, the container is then closed around the article group. Such containers either can be substantially flat, creased carton blanks which are then folded around an article group, or partially formed, open ended containers in which the articles are directed into the containers through one end. The container ends are then closed by folding flaps across the open ends and gluing the flaps together. Some prior packaging machines perform the article selection, article grouping and article packaging functions in discrete steps, requiring interruption of the flow process.

The problem of process flow interruption was addressed in later packaging machines which utilize guide rails to divide the articles into distinct flow paths, and selector wedges or flights cooperating with the guide rails to pick or rake a predetermined number of articles, arrange the articles in an article group and transfer the article group into a container. These machines are substantially continuous motion packaging machines intended to package articles into various types of containers without flow interruption. An example of this type of packaging machine specifically designed to load articles into open ended cartons is disclosed in U.S. Pat. No. 3,778,959 to Langen et al. While in some respects this machine constituted an improvement over prior machines, it still is quite limited in that each machine lacks the mechanical flexibility to package articles of various dimensions during different process runs and in a variety of product or package configurations. In other words, the Langen et al. device is limited to processing articles of a specific diameter into specific article group configurations. Considering that today a very wide range of article types and dimensions are packaged, this constitutes a serious limitation. Additionally, this machine also includes repetitive elements and requires excessive machine structure arrangements.

Another packaging machine design is disclosed in U.S. Pat. No. 4,237,673 to Calvert et. al. This machine also is a continuous motion machine utilizing guide rails and employing a type of selector wedge in the form of a metering bar. The metering bars are relatively massive, extending substantially across the entire machine to rake articles into article groups and to transfer the article groups into each end of an open ended container. While this machine necessarily retains many disadvantages due to its design, the guide rail and metering bar arrangement also make it impossible to readily package articles of different dimensions.

Another example of a continuous motion packaging machine of this type is disclosed in U.S. Pat. No. 4,887,414 to Arena. This device uses guide rails and selector wedges to direct articles onto substantial flat, creased carton blanks, which are then folded about the article group. While this machine constitutes substantial improvements over the prior art devices, it nevertheless is limited to packaging a specific article size in a specific article group configuration.

Additionally, packaging machines which package articles in containers using the end loading method, typically either arrange an article group and direct the entire article group transversely into the open ended container, or arrange an article group and transfer the articles in staggered relationship to one another into the open ended container. Transferring staggered articles when open ended containers are used has been found to accomplish tighter article packaging within the carton, which is a desirable result. The method of transversely directing a unitary article group into an open ended container usually requires an additional step to form the container tightly around the articles, in order to accomplish the packaging within typical industry tolerances.

While the continuous motion packaging machines described above have permitted relatively high speed, uninterrupted article packaging, none of these machines is flexible in their abilities to selectively package articles of different dimensions, such as article diameters, and in different product configurations. This limitation has become quite acute and is even more of a disadvantage today, since products are now marketed in an ever increasing range of sizes and in many different product configurations. Changing from different article sizes or product configurations has required either the utilization of additional packaging machines, or that the packaging machine essentially be dismantled and rebuilt, if possible, to package articles of different sizes or configurations.

SUMMARY OF THE INVENTION

The present invention comprises a highly flexible packaging machine in terms of its ability to package articles of various dimensions, including diameter and height, in selective product group configurations. This invention permits at least four types of flexibility: configuration flexibility, diameter flexibility, height flexibility, and carton-type flexibility. Configuration flexibility relates to the machine's ability to readily package articles in desired product group configurations. The product group configuration within a package container refers to the arrangement of articles in columns and rows within the container. This packaging machine permits the number of rows and columns to be readily altered.

Another important advantage of the present invention is its ability to package articles of various dimensions. For example, the machine readily can be adjusted to package articles, such as bottles or cans, of various diameters and heights on different product runs. Additionally, the machine can be adjusted to change both the product group configuration and accommodate articles of larger or smaller diameters on different product runs. Finally, the machine can be readily adjusted to accommodate many different types of containers or cartons. The high flexibility of the present invention, therefore, provides for cumulative advantages not presently attained by packaging machines of the known prior art.

To accomplish this high degree of flexibility, the present invention includes many structural features which are utilized either alone or in combination to alter the various product criteria. Guide rails disposed in angled relationship to the machine's longitudinal dimension and process flow paths define lanes through which the articles are arranged and conveyed. The lane width can be selectively adjusted by adjusting the guide rail position to accept articles of different diameters on different product runs. Providing for the guide rail adjustment, however, poses unique problems, considering the relationship of the guide rails to the other cooperative machine elements. Altering article diameters on a selector flight-type packaging machine also requires that various other elements of the machine be adjustable. When the article group is changed, the wedged shape selection end portion of the selector flight normally must be changed in order to provide for optimum article selection. Otherwise, undesirable forces are directed against the article, resulting either in damage to the article and jamming of the machine or in inefficient machine operation. The present invention readily accommodates the changes in article dimensions and product configurations, and provides for easy selector flight replacement to optimize article selection and process flow.

Changing article diameters, however, necessitates that the selector flight mechanism also be adjustable, since the width of the article group has been changed. The present invention provides for the selective phasing of the selector flights or wedges, depending upon the article diameter and the number of article columns between successive flights. The selector flights are carried by a conveyor, such as two pairs of endless drive chains, which includes a phase adjustment mechanism. A further adjustment feature combines changing wedges to achieve optimum wedge design with the ability to phase the flights. This aspect of the invention contemplates determining an optimum wedge design for a particular product diameter and product configuration, determining an optimum wedge design for a secondary product diameter and/or configuration, and combining these wedge designs to result in a "split wedge" or flight. The wedges are then phase adjusted until successive wedges are nested together or combined to form a unitary selector flight suitable for a desired product run. When the product configuration or article diameter is changed to process the secondary product, the nested selector flights can be phase adjusted apart to convert the packaging machine to accommodate a product run of articles having different diameters. In this case, the selector flights are considered to be "split," so that the spaces or pockets defined between successive selector flights are divided.

Another variable machine assembly is the container or carton transport mechanism. The carton transport mechanism also comprises a conveyor, such as pairs of endless drive chains, carrying upstanding lugs. The lugs support fill blocks, and are arranged in spaced relationship along the carton transport conveyor to define spaces or pockets in which empty cartons are inserted. The fill blocks contact the cartons and operate as leading or trailing carton flights. Successive fill blocks on each side of the container are designed to contact the container along a common vertical plane. The upstanding lugs and their associated fill blocks also are phase adjustable so that the carton pockets can be split in order to accommodate cartons of different dimensions. The respective adjustments of these machine elements are interrelated to a large extent.

Thus, the phase adjustment of the carton flights to split or divide carton pockets requires that the selector flights also be phase adjusted to create an identically sized article group pocket which is transversely aligned.

The cooperation of these elements of the present invention results in a packaging machine which is highly flexible, allowing a single machine to be readily utilized for different articles and containers. Accordingly, the objects of the present invention include the ability to readily convert the machine to process articles of different diameters or heights, to readily alter the configuration of product or articles and to permit various carton types and dimensions to be readily used. The present invention accomplishes the above-stated objects while providing for efficient, continuous, high speed article packaging.

DETAILED DESCRIPTION OF THE PREFERRED EMBODIMENTS

Figure 1:
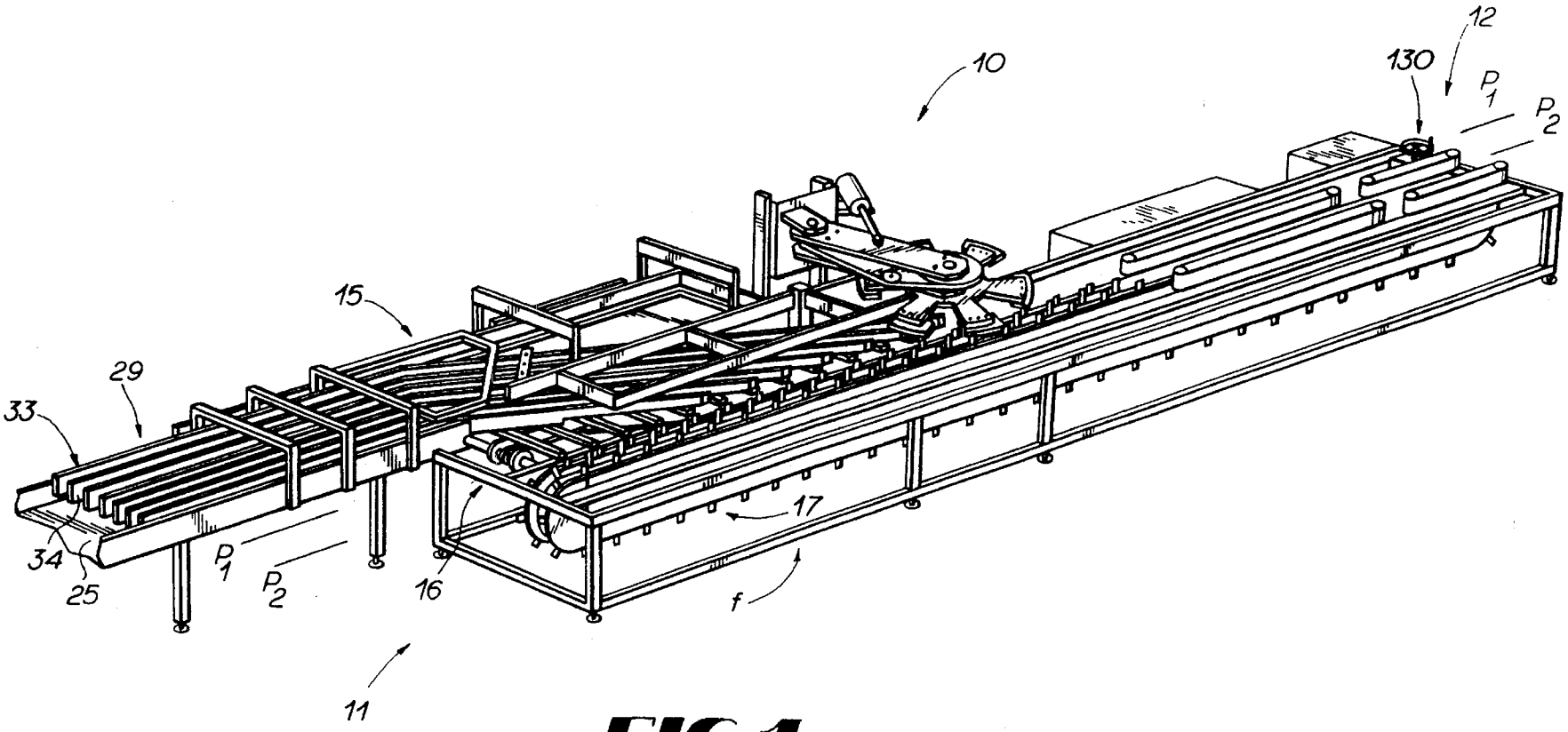
FIG. 1 is a perspective view of a packaging machine of the present invention.

FIG. 1 shows packaging machine 10 having infeed end 11 and outlet end 12. The various components of packaging machine 10 can be incorporated into and supported in component form by separate support frames, or the components can be incorporated into a unitary support frame. The embodiment shown and described utilizes a unitary, steel support frame, the various elements of which are generally denoted f, having the structure necessary to support the components of the present invention. Packaging machine 10 is elongate, extending longitudinally from infeed end 11 to outlet end 12. The principal, operative components of packaging machine 10 comprise article infeed 15, article selector 16, container transport 17, and carton placer 18. Article selector 16 and container transport 17 each are disposed along separate longitudinal paths $P_1$ and $P_2$, running along the length of packaging machine 10. As is described in further detail below, the article selector and the container transport are arranged side by side, and function in timed synchronization to facilitate directing articles into the containers. The general direction of process flow is from infeed end 11 to outlet end 12 along these longitudinal paths, although the articles are directed into containers substantially transversely to this general process flow direction.

Figure 2:
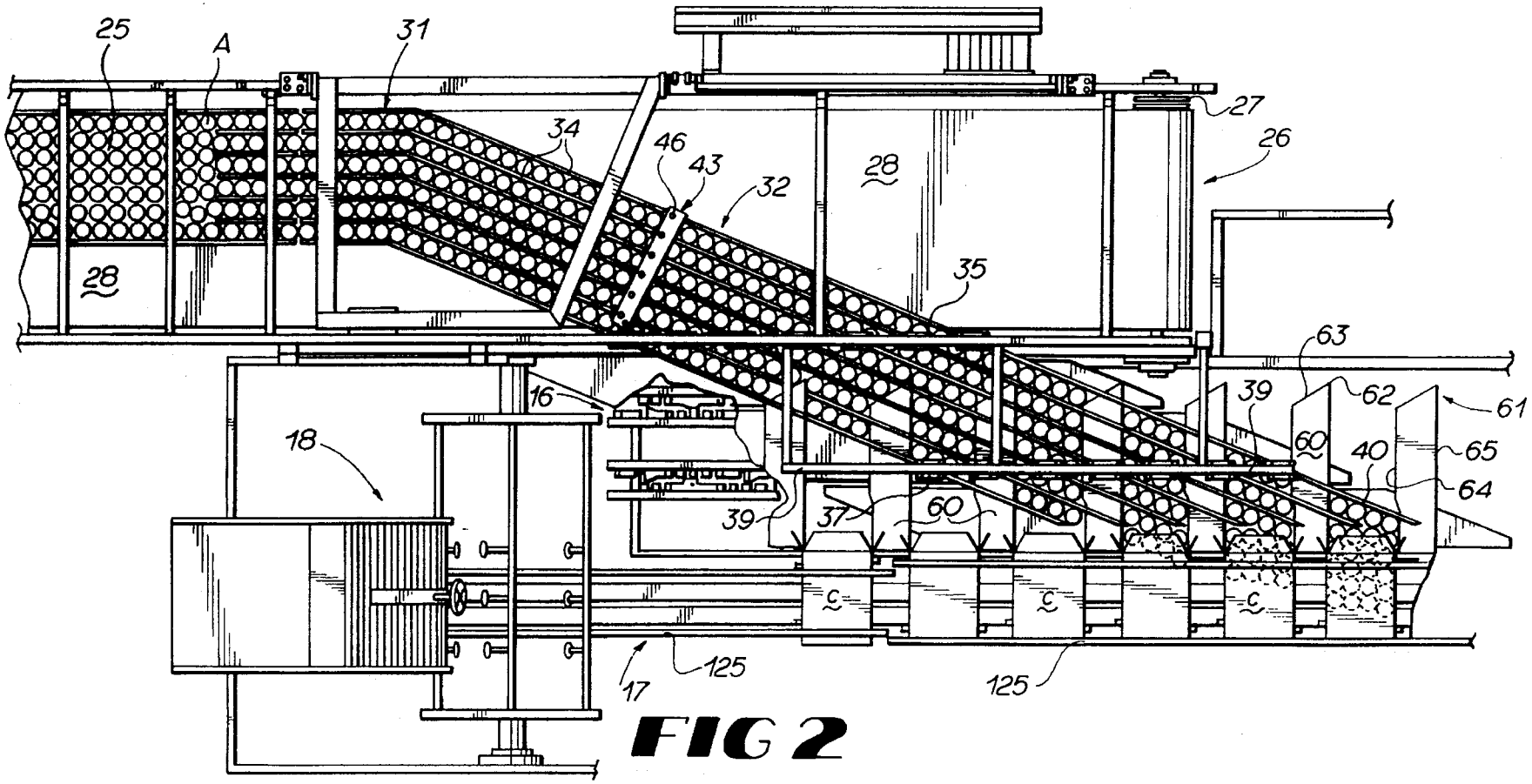
FIG. 2 is a plan view of the article infeed mechanism, article selector mechanism, carton transport mechanism and carton placer.

The article infeed 15 comprises infeed supply chute 25 extending rearwardly from infeed end 11, through which the articles A are supplied. The article infeed also includes conveyor 26 disposed above supply chute 25 in order to actively transport articles through the article infeed and to the article selector 16. The conveyor 26 can be a belt conveyor, and includes drive roller 27 driven by a suitable motor (not shown) and conveyor belt 28. The article infeed conveyor 26 can extend from adjacent to the article selector 16, as shown in FIG. 2, rearwardly along article supply chute 25. Optionally, the articles may be transported across the article supply chute by way of article line pressure up to a point where the infeed conveyor 26 begins actively feeding the articles toward the article selector. Article infeed 15 further comprises guide rail unit 29 which extends longitudinally along the article supply chute to a point approximately adjacent to carton transport 17. At a position approximately adjacent to carton placer 18, the guide rail unit angles toward article selector 16. FIG. 2 shows guide rail unit 29 at an acute angle to the longitudinal paths $P_1$ of the article selector and the path $P_2$ of the container transport, respectively. Guide rail unit 29 is further comprised of corner guide rail section 31, angled guide rail section 32, and infeed guide rail section 33. Each guide rail section includes parallel, spaced guide rails 34 suspended from the machine support frame f, and positioned above and spaced from the article supply chute, infeed conveyor and the article selector, respectively. The guide rail unit 29 positions, arranges, and directs articles A into the operative position for packaging, as shown in FIG. 2. The spaced parallel guide rails 34, therefore, define discrete lanes 1 of predetermined widths w along which the articles are directed. Importantly, the packaging machine of the present invention provides for lane width adjustability. This adjustability, along with other adjustable elements of the invention, permits this packaging machine to process articles of different dimensions into various package configurations on different process runs.

The guide rails 34 of angled guide rail section 32 and infeed guide rail section 33 are laterally or horizontally adjustable with respect to one another back or forth along the general path of process flow, to vary the lane width. An elongate, horizontally disposed beam 35 extends in the longitudinal direction of the packaging machine approximately midway over angled guide rail section 32. Beam 35 defines a dovetail flange 36 along its lower edge which functions as a track. Cooperating with and in slidable engagement with dovetail flange 36 are linear bearings 37. Guide rail supports 38 are fixed to and downwardly extend from each linear bearing. The guide rail supports 38 also are in fixed attachment to the top edge portion of a respective guide rail 34 of angled guide rail section 32. A second beam 39 disposed over the article selector 16 is identical in structure and function to beam 35. Additional linear bearings and guide rail supports extend downwardly from and slidably engage beam 39, with the guide rail supports being attached to the upper edges of the outer ends of the associated guide rails of angled guide rail section 32, to provide additional support. The parallel guide rails of infeed guide rail section 33 can be adjusted using similar elements. Preferably, one guide rail of section 32, such as the outermost and longest rail 40, is immovably fixed to beams 35 and 39. It is therefore evident that the guide rails of the angled guide rail section readily can be adjusted along beam 35 in either direction in the longitudinal or elongate dimension of the packaging machine to vary the widths of the lanes 1.

Figure 3:
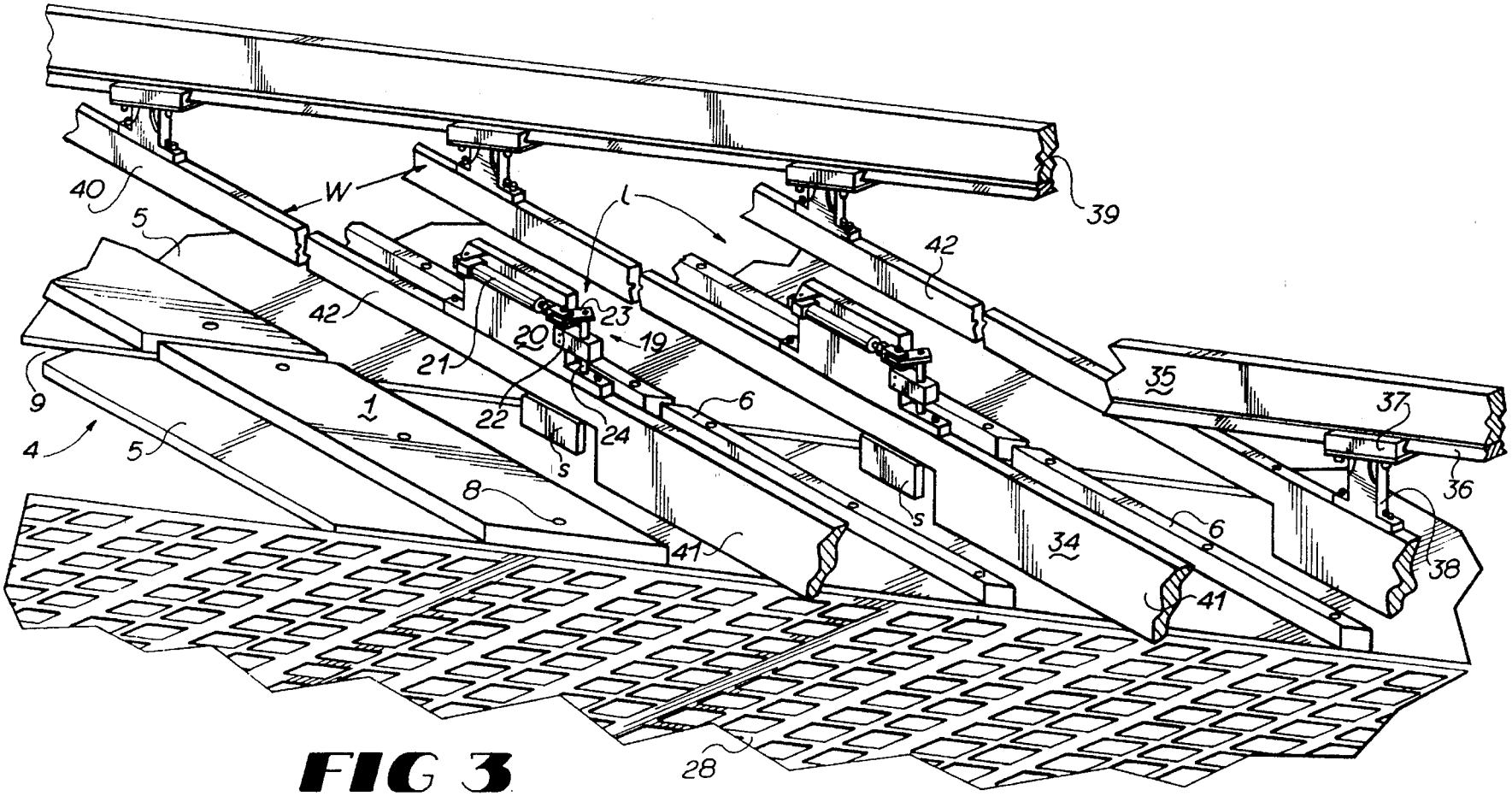
FIG. 3 is a fragmentary, perspective view of the guide rail adjustment mechanism of the present invention.

As shown in FIG. 3, guide rails 34 of section 32 include an inner rail end portion 41 which is wider in the horizontal dimension than its associated outer end portion 42. The bottom edge of outer rail end portion 42, therefore, is spaced above the article infeed section 15 and the article selector section 16 a greater distance than the bottom edge of rail end portion 41. This provides for a notch in these guide rails, allowing for the dynamic cooperation of the article selector 16 and the guide rails 34, as further described below.

FIG. 3 also illustrates bed plate assembly 4 positioned between conveyor 28 and container transport 17 along longitudinal path $P_1$. Bed plate 4 includes flat horizontally disposed slide plates 5 positioned on the same horizontal plane as the top of conveyor 28 and carton transport 17 to enable articles to freely slide from conveyor 28 over slide plate 5 and into containers placed on the top surface of container transport 17. Bed plate 4 can optionally include upstanding bed plate guides 6 positioned directly below adjustable guide rails 34 and are of the same width as guide rails 34. Bed plate rails 6, being in vertical alignment with guide rails 34, thus define the lower portion of lanes 1 and help stabilize articles being transported through lanes 1 toward article selector 16. The last bed plate rail 7 is shown being wider than rail 6 and positioned below the last and longest guide rail 40. The bed plate rails 6 and 7 are securely attached to bed plates 5 in any suitable manner, such as with fasteners 8, and are spaced in three sections to define channels 9 therebetween to accommodate upstanding selector flight fasteners 82 therethrough. Only one channel 9 is shown in FIG. 3. Bed plate 5 and bed plate rails 6 and 7 preferably are made of low friction synthetic material such as nylon or plastic to enable articles to slide easily across the bed plate. If bed plate rails are utilized, the bed plate or the bed plate rails must be changed if the positions of the guide rails 34 of section 32 are changed.

A lane blocking device or lane block assembly 19 is mounted on the upper surface of guide rails 34 along one side of each lane 1, in order to selectively interrupt the flow of articles being directed through article infeed 15 toward article selector 16. The lane block assembly includes an upstanding, planar support bracket 20 which horizontally supports or carries an actuator, such as a pneumatic piston and cylinder assembly 21. A clevis 22 attached to the piston rod pivotally actuates a strap 23 which is fixed to a vertically, downwardly extending pivot shaft 24. The pivot shaft 24 is supported at its lower end and journeled by guide rail 34, extending through the narrower, outer end portion 42 of guide rail 34. Attached in fixed relationship to the lower end of vertical pivot shaft 24 is a lane stop s. The control mechanisms for lane block assembly 19 are not described herein, and any conventional pneumatic control assembly which allows for selective actuation of piston and cylinder assembly 21 is suitable.

Upon actuation of assembly 21, the associated piston rod is forced outwardly, causing clevis 22 to rotate the strap and also the vertical pivot shaft. This causes the stop s to turn into an adjacent lane, thus interrupting article flow toward article selector 16. Since this packaging machine provides for lane width adjustability, the lane block assemblies preferably are attached to the guide rails 34. Although other lane blocking assemblies may be suitable, the fact that the operative article infeed lanes can be shifted must be taken into account when selecting a lane block assembly. If the lane block device is incorporated onto the guide rails, however, the requirement of an additional adjustment device for positioning of the lane block assembly is unnecessary. Also the assembly 19 described above inserts the lane stop s from the side of the lane 1, and so is capable of inserting the stops into the article flow stream even when articles are present. This capability makes it possible to stop articles from entering the article selector 16 with enough precision to prevent any specific article group from being configured. This allows an article group to be skipped if a missed or improperly formed group were detected.

Figure 5:
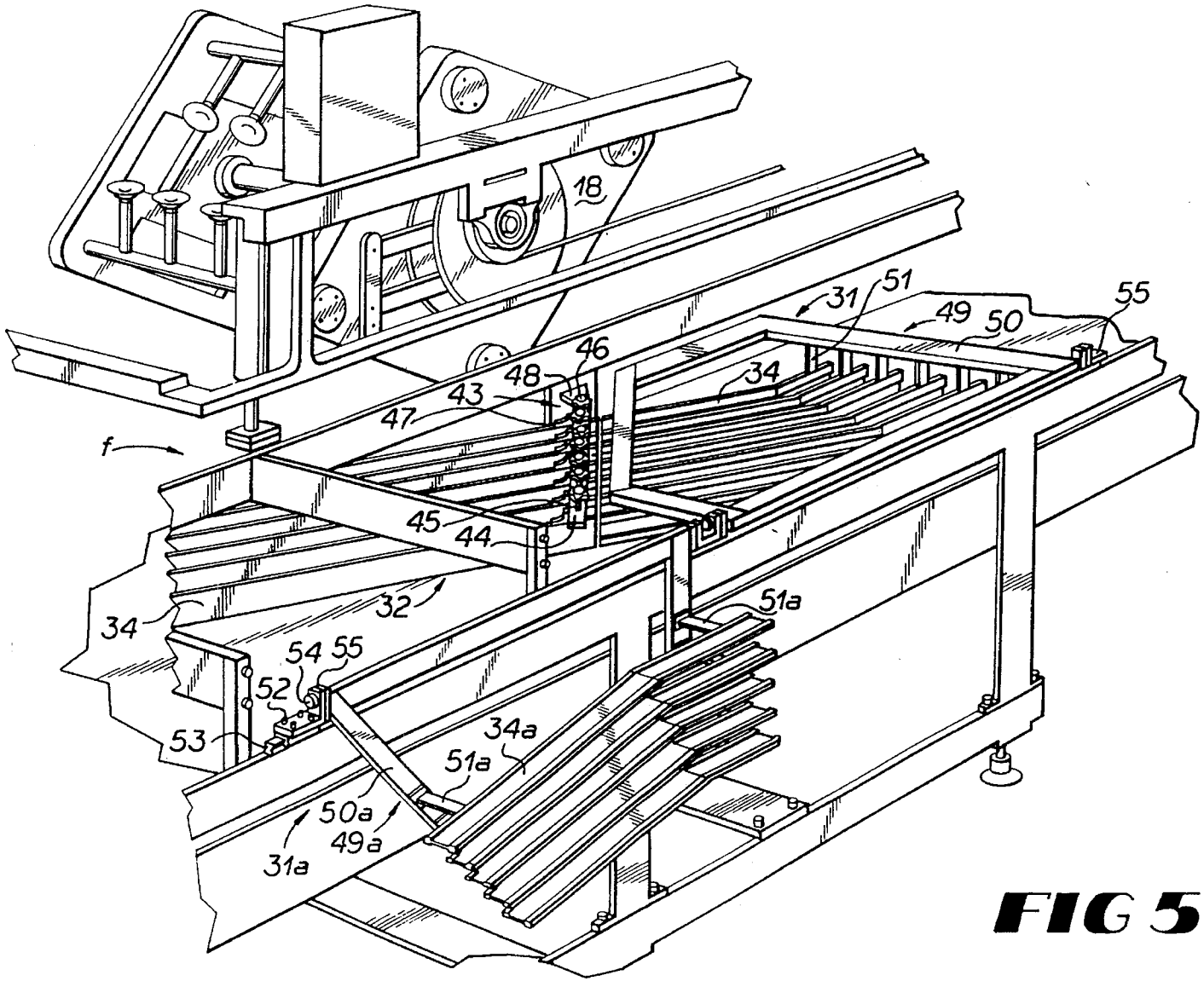
FIG. 5 is a perspective view of the corner guide rail section.

The forward ends of guide rails 34 of guide rail section 32 extend to a position substantially adjacent to the inner edge portion of container transport 17. A guide rail anchor 43 is releasably attached to the guide rails of angled guide rail section 32 at its rearward end. The anchor 43 includes an elongate locking bar 44 which defines apertures 45 therethrough. Extending downwardly through apertures 45 are the externally threaded shanks of locking bolts 46. The bolts 46 are received and threaded into internally threaded apertures defined by upstanding supports 47, which engage and are fixed to the upper edge portions of the guide rails of the angled guide rail section, as shown in FIG. 5. At one end, anchor 43 also engages horizontally extending anchor support 48 which, in turn, is attached to the packaging machine frame f. Anchor 43 is used to fix the positions of these guide rails with respect to one another after the guide rails of section 32 have been selectively adjusted. Preferably, other anchors having bolts with different spacing than anchors 43 are provided to anchor guide rails 34 in a different position.

Corner guide rail section 31 is positioned at the rearward or infeed end of angled guide rail section 32. The guide rails 34 of corner guide rail section 31 are fixed and nonadjustable with respect to one another. The guide rails of corner guide rail section 31 are supported in spaced relationship above conveyor belt 28 by support frame 49. Support frame 49 includes a horizontally disposed, angled support 50 carrying downwardly extending arms 51. Arms 51 are fixed to the upper edge portions of guide rails 34 of corner guide rail section 31, so that these guide rails are in permanent fixed relationship with respect to one another. The guide rails of corner guide rail section 31 must be fixed with respect to one another, and therefore not attached to the guide rails of angled guide rail section 32. This is due to the linear or longitudinal adjustment feature of angled guide rail section 32.

Since the longitudinal adjustment of the guide rails of angled guide rail section 32 would not correspondingly adjust the guide rails of corner guide rail section 31, additional corner guide rail sections must be provided to facilitate processing of articles of different diameters. For ease of adjustability, several such corner guide rail sections having guide rails spaced to define lanes of various widths are attached to the packaging machine. FIG. 5 shows two such corner guide rail sections, 31 and 31*a*, having identical elements. The spacing between the respective guide rails of these sections, however, differ, and are designed to mate with a different adjustment of the angled guide rail section. Each guide rail unit 31 and 31*a* is mounted on linear bearings 52, which slidably engage dovetail shaped track 53 of the packaging machine support frame. The guide rail units 31 and 31*a* are pivotally supported by pins 54 on support brackets 55, thus allowing each respective corner guide rail section to be independently pivoted out of operative alignment with angled guide rail section 32, slid out of position by way of linear bearings 52 along track 53, thus allowing another corner guide rail section defining a different lane width to be placed in operative alignment with angled guide rail section 32.

Figure 4:
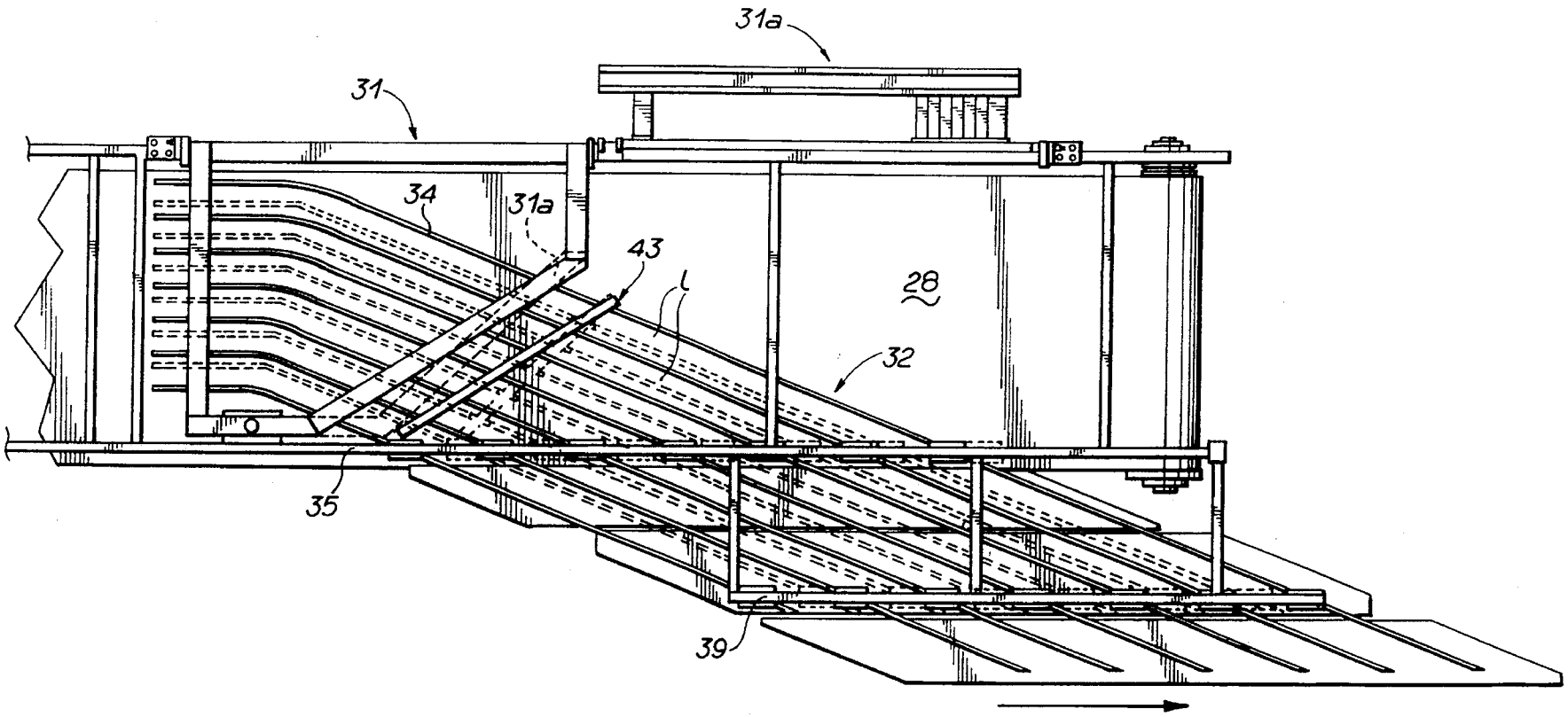
FIG. 4 is a plan view of the article infeed mechanism depicting guide rail adjustment in phantom lines.

FIG. 4 depicts corner guide rail section 31 and angled guide rail section 32 in cooperative alignment. Also shown in phantom lines are the respective guide rails of the angled guide rail section, having been adjusted by sliding the guide rails laterally along beams 35 and 39 in the direction of machine flow marked by the arrow. This accomplishes a width adjustment of the lanes 1 defined between juxtaposed guide rails 34 of the angled guide rail section. FIG. 4 also illustrates the corner guide rail section 31 and, in phantom lines, corner guide rail section 31*a* depicted in alignment with guide rails 34 of the angled guide rail section 32 after their adjustment. It therefore is obvious that the packaging machine of the present invention provides for guide rail adjustability so that articles of different and varying diameters can be processed, or packaged during continuous machine operation. Furthermore, the adjustability features described above allow the guide rail sections of the packaging machine 10 to be easily and readily adjusted with a minimum of process interruption.

Article selection mechanism or article selector 16 functions in cooperation with article infeed 15 to select a predetermined number of articles and to arrange the articles into an article group. A function of this packaging machine's ability to process articles of different diameters is the adjustability of the article selector 16. The article selector is a flight type article selection mechanism utilizing horizontally disposed, elongate flights 60 arranged transversely to the longitudinal flow path of selector 16, to rake or pick articles from the article infeed lanes defined between the outer end portions of guide rails 34 of the angled guide rail section 32. Each flight includes a selection end 61 which is wedge shaped, having a leading apex or point 62 and a rearwardly tapering angled surface 63, angling toward the trailing edge 64 of the flight. Apex 62 can be slightly rounded, if desired. Opposing the trailing edge 64 of each flight is a leading edge 65. The specific structural design of the selection end 61 of the flights may vary, depending upon the diameter of the article being selected. While in some instances the same selection end design may function acceptably for articles of different diameters, particularly when the diameters are very close, often an improperly designed selector flight for a particular article diameter will result in the article being damaged and the packaging machine becoming jammed. Since the present invention is designed to process articles of varying dimensions, the article selector 16 includes adjustable features to permit the use of an optimal wedge or flight design for a particular article.

Figure 6:
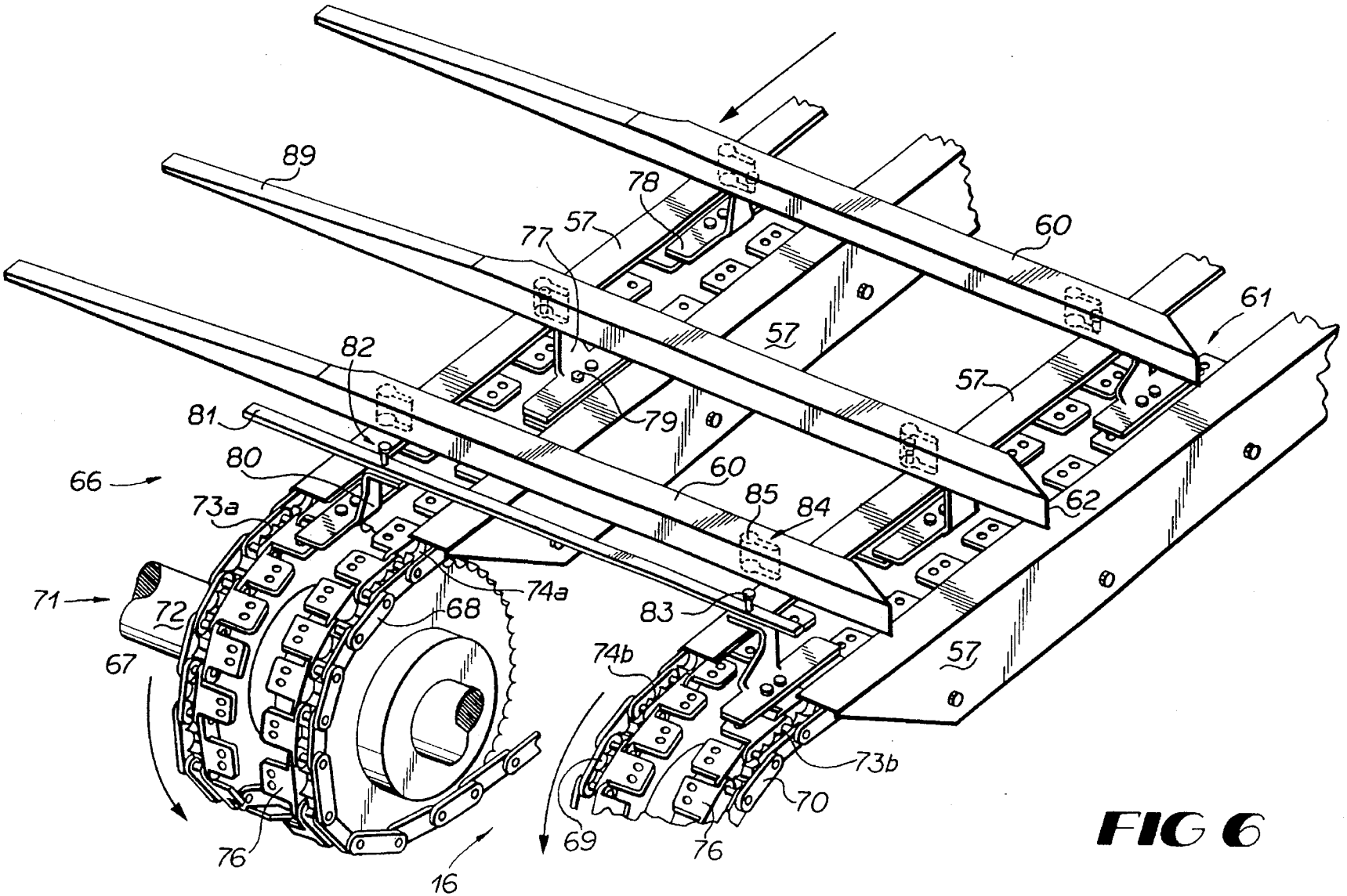
FIG. 6 is a fragmentary, perspective view of the article selection mechanism.
Figures 6A, 6B:
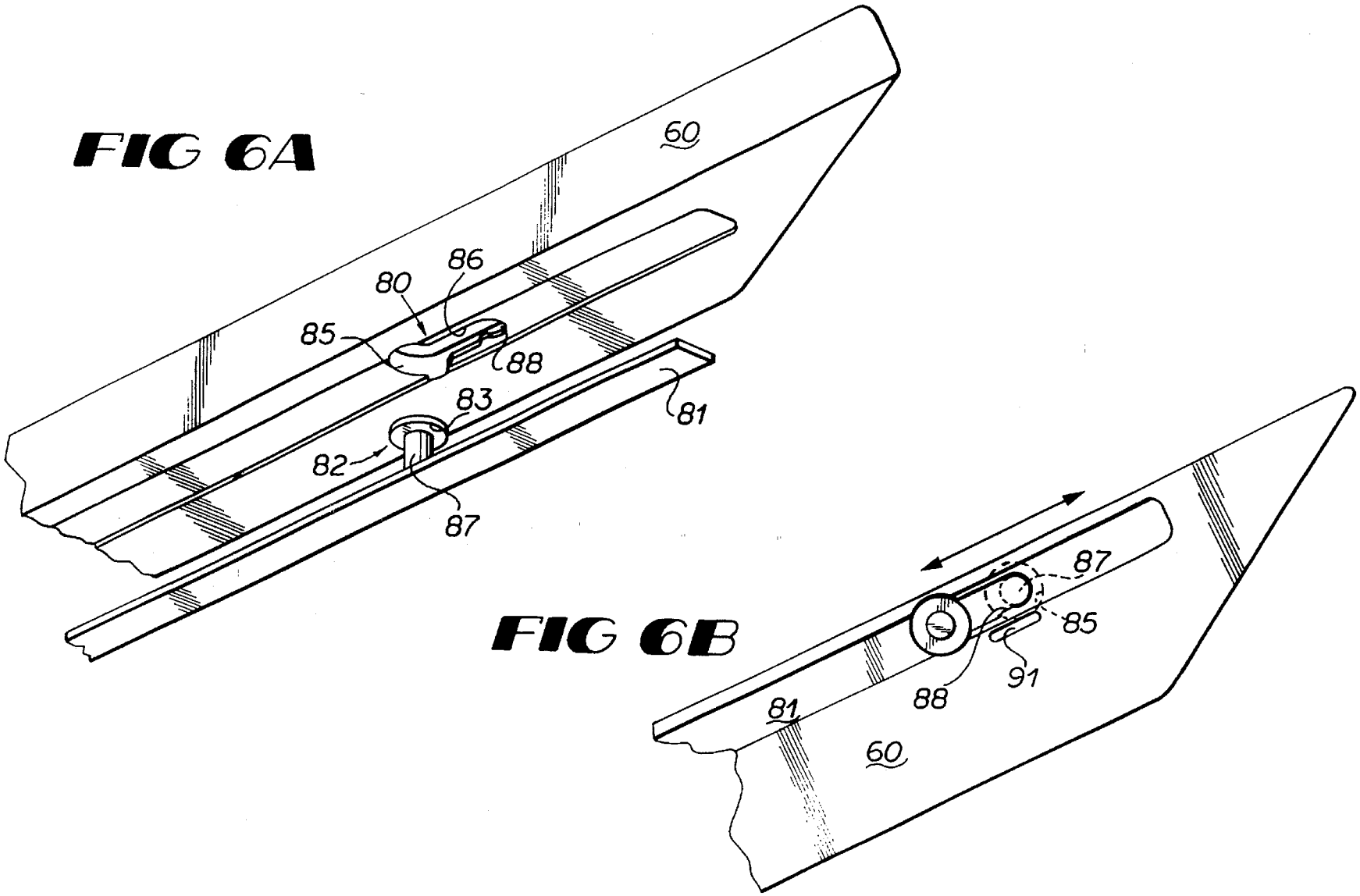
FIG. 6A is a perspective view of the internally molded selector flight channels.
FIG. 6B is a plan view showing engagement of a selector flight to a crossbar.

The article selector 16 comprises a conveyor 66 having four separate conveyor chains 67, 68, 69 and 70, as shown in FIG. 6. These conveyor chains extend in endless fashion longitudinally along a longitudinal path $P_1$, substantially from infeed end 11, terminating a distance from outlet end 12. Elongate, C-shaped conveyor chain guides 57 provide structural support for the conveyor chains. Chain conveyors of this type are well known in the art and include a drive axle and associated drive gears to form a conveyor drive 71. Conveyor drive 71 includes draft shaft 72, outer drive gears 73*a* and 73*b*, and inner drive gears 74*a* and 74*b*. Article selector 16 also includes a chain phasing selector 75, the mechanical gearing and components of which are in functional cooperation with conveyor 66. Conveyor phasing mechanisms, such as chain phasing selector 75, which permit the selective phasing or movement of one or more chains in a chain conveyor system with respect to the remaining chains in the system, are well known in the art and are not further described in detail. Conveyor chains 67, 68, 69, and 70 support horizontally extending lug brackets 76 at each conveyor link. At spaced intervals along each conveyor chain, and supported by lug brackets 76 are upstanding lugs 77. Lugs 77 include a horizontally disposed lug base 78 which is attached by pins 79 to lug brackets 76, and an upwardly projecting, inwardly extending L-shaped crossbar support 80. Pairs of lugs are positioned with the L-shaped crossbar support 80, facing inwardly toward each other, as shown in FIG. 6. Corresponding lugs attached to outer chains 67 and 70 are paired together and, similarly, corresponding lugs attached to inner chains 68 and 69 are paired together. Pairs of lugs 77 are arranged along conveyor 66 so that every other lug pair is attached either to the inner chains or to the outer chains, respectively. For example, FIG. 6 shows a first pair of lugs attached to outer chains 67 and 70, the second pair of lugs attached to inner chains 68 and 69, the third pair of lugs attached to outer chains 67 and 70, and so on. This lug and chain arrangement allows selective chains, and their associated lugs, to be position-phased with respect to the lugs on the nonassociated chains.

In this embodiment, inner chains 68 and 69 are the phasing chains, capable of being repositioned along conveyor 66. Chain phasing selector 75 is mechanically coupled to conveyor 66 so that the starting position of chains 68 and 69 can be incrementally changed with respect to the starting position of chains 67 and 70. This allows the lugs associated with the inner chains to be moved with respect to the lugs associated with the outer chains 67 and 70. The inner chains thereby can be phased to increase, decrease, or even eliminate the distance between successive pairs of lugs, and thereby either increase or decrease the size of the space or pocket between the lugs for the containers. The inwardly projecting L-shaped portion of the lug forms a base for elongate, transversely extending crossbar 81. Positioned above the lug supports 80 and projecting upwardly from crossbar 81 are flight retaining pins or fasteners 82. Retaining pins 82 include an enlarged head 83.

Flights 60 are releasably retained on crossbar 81 through the cooperation of fastener 82 and slot 84 defined within flights 60. The flights preferably are injection molded of a low friction synthetic material such as nylon or a plastic. The flights are molded to define slots 84, which are positioned to receive fasteners 82. Slot 84 includes an enlarged portion 85 sized to receive the head 83 of the fastener. Slot 84 also includes an elongate channel 86 of decreased diameter with respect to engaged portion 85. Elongate channel 86 is of the approximate width equal to the diameter of the shank 87 of fastener 82. The flights 60 define at the intersection of enlarged recess 85 and elongate channel 86, an inwardly extending projection or detent 88 which effectively decreases the width of elongate channel 86 at that position. A deflection slot 91 is defined in flight 60 adjacent to detent 88 to allow for the movement of detent 88 due to the force applied by the shank of fastener 82 and the inherent elasticity of the synthetic material of flight 60. The shank of the fastener 82 can be forced past detent 88 to be releasably retained in channel 86, since slot 91 allows for the movement of detent 88. In this fashion, the flights are releasably engaged onto flight retaining fasteners 82. The retaining elements of the flights, therefore, are incorporated directly into the substrate of the flights themselves. The flights 60 are easily removed from and replaced onto fasteners 82 in this manner, thus allowing for quick flight replacement in the event that adjustment is necessary to accommodate articles of different diameters. No separate retaining element or fastening device is required to install or remove new flights.

As stated previously, the shape of selection end 61 of the flight should be specifically designed depending upon the diameter of the article selected and other variables described below. While in some instances a particular design of a wedge shaped selection end 61 will acceptably function to select articles of various diameters, often the selection end design, or wedge geometry construction, should be changed in order to provide for the most efficient and optimal article selection.

In determining wedge geometry, the wedge width should be calculated. The wedge width is dependent upon machine pitch, the article or product diameter, the number of articles to be selected between successive wedges, or article columns, a distance for article clearance, and the angle between the guide rails of angled guide rail section 32 and the longitudinal direction of machine flow. All flight-type packaging machines are set at a specific pitch. The pitch of the packaging machine as related to the selector flights is equal to the distance from one point of a selector flight or wedge 60 to the identical point on a juxtaposed flight. Machine pitches are preset in the machine design, but can be changed in the present invention with phasing mechanisms, such as chain phasing selector 75. Typically, the pitch of the flights on flight-type selector packaging machines are preset from 10 inches to 15 inches. While the selector flight pitch on known prior art packaging machines is fixed, the pitch of the selector flights of the present invention is adjustable. Flight or wedge width (ww) has been found to be acceptably determined by the following formula:

$$ww = P - \cos\alpha \left[ (u-1)d + 2\left(\frac{d/2}{\cos\alpha}\right)\right] - C_1$$

where p equals machine pitch; u equals the number of article columns, or articles between successive selector flights; d equals article diameter and $\alpha$ equals the acute angle between the guide rails 34 of section 32 and the longitudinal path or direction of machine flow. $C_1$ is equal to a clearance distance. In determining flight selector width, and also in determining the difference between successive wedges, the distance to allow for article clearance must be considered. This article clearance distance $C_1$ is a necessary factor, since some distance must be allowed between successive flights to accommodate the dynamics of arranging the articles in product group configurations and additionally because some articles, especially bottles, have a slight variance in diameters. The clearance distance $C_1$ is an arbitrary value, which has been found optimally to exist between 1/32 inch and 3/32 inch. Using the equation above, and considering these factors, the wedge width ww is calculated.

Figure 12:
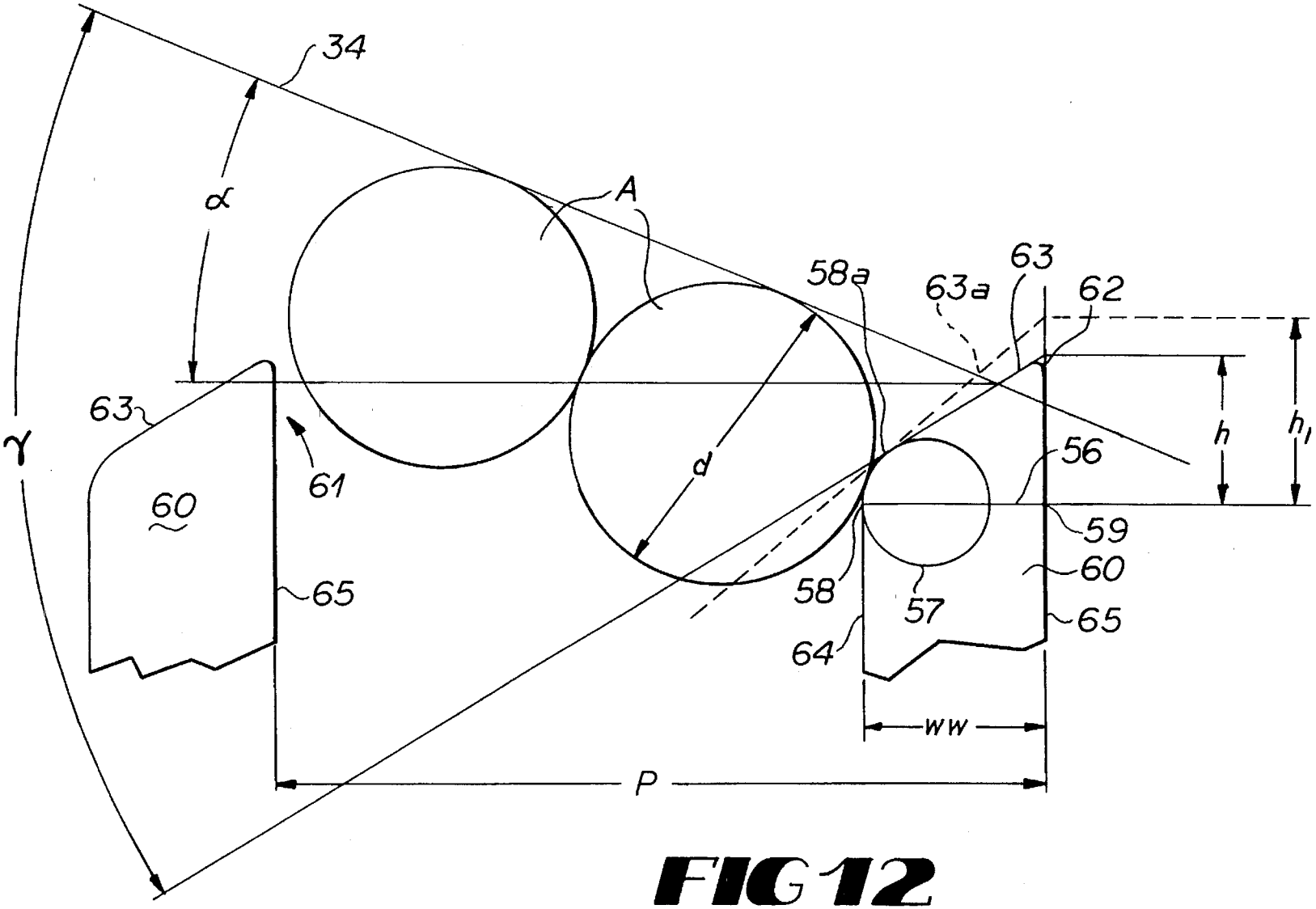
FIG. 12 is a schematic plan view of the selector flights incorporating flight geometry design variables.

The geometry of the wedge-shaped end portion 61 is then determined. Referring to FIG. 12, height h first must be determined according to the following equation:

$$h = (U-1)d\,\mathrm{SIN}\alpha + \frac{\dfrac{\frac{d}{2}}{\cos\alpha} - \dfrac{d}{2}}{\mathrm{TAN}\alpha}$$

After h is calculated, the distance must be incorporated into the flight selector design so that ultimately the orientation of rearwardly tapering angled surface 63 can be determined. Using calculated wedge width ww, leading edge 65 and trailing edge 64 are drawn and terminate at a line or axis 56 which is normal to parallel edges 64 and 65. A circle 57 having a radius equal to or approximately ½ inch is drawn, as shown in FIG. 12, with the circle contacting trailing edge 64 at the point where axis 56 and edge 64 intersect. This point of intersection 58, therefore, is the point where trailing edge 64 contacts circle 57 as a tangent line thereto. FIG. 12 shows this relationship in which part of axis 56 therefore becomes the diameter of circle 57. The point of intersection 59 of axis 56 and leading edge 65 is a point from which h should be drawn, as shown in FIG. 12. The value of h, which in effect becomes an extension of leading edge 65 from point 59, terminates at apex 62. A line, which constitutes angled trailing edge 63, is then drawn from apex 62 rearwardly towards trailing edge 64 so that line or edge 63 becomes another tangent line with respect to circle 57, contacting circle 57 at point 58*a*. Thus, the rearwardly tapering edge portion 63 of selector flight 60 is established, creating an acceptable wedge geometry for selection end 61.

It has been found that the geometry of selector end 61 is improved, allowing for more efficient and smoother article selection, if the flight selector end portion at apex 62 is slightly rounded, and if the selector flight trailing edge portion at the intersection of edge 63 and edge 64 also is rounded to conform to the arc of circle 57 between point of intersection 58 and point of intersection 58*a*.

It also has been found that the performance of the selector wedges when packaging machine 10 operates at higher speeds is enhanced when the distance h is increased by a certain amount. This increased distance $C_2$ is computed using the following equation:

$$C_2 \leqq (90-x)(0.015\ inches)$$

where x is a unitless value numerically equal to the angle $\gamma$ between the trailing edge 63, as originally determined using the formulas above, and guide rail 34 of guide rail section 32. The value of $C_2$ expressed in inches is then added to h to arrive at a new distance $h_1$. This new distance $h_1$ optionally can be substituted for h, and the resulting selection end portion 61 can be then recalculated to arrive at a new edge 63*a* disposed at a different angled orientation, as shown in FIG. 12, using the variables and procedures discussed above. While the geometry of the selector end 61 using h in these formulas allows flights 60 to function adequately, it has been found, however, that the selector flights function optimally at higher speeds, those approaching 250 feet per minute, when $h_1$ is used instead, as described above. Some of the lines in FIG. 12 have been extended or are shown as phantom lines for ease of illustration.

The end 89 of flight 60 opposite that of the selection end 61 should extend to be adjacent the open end of container C on container transport 17, as shown in FIG. 2. Preferably, flight end 89 is of a reduced vertical dimension than the selection end 61.

Figure 7B:
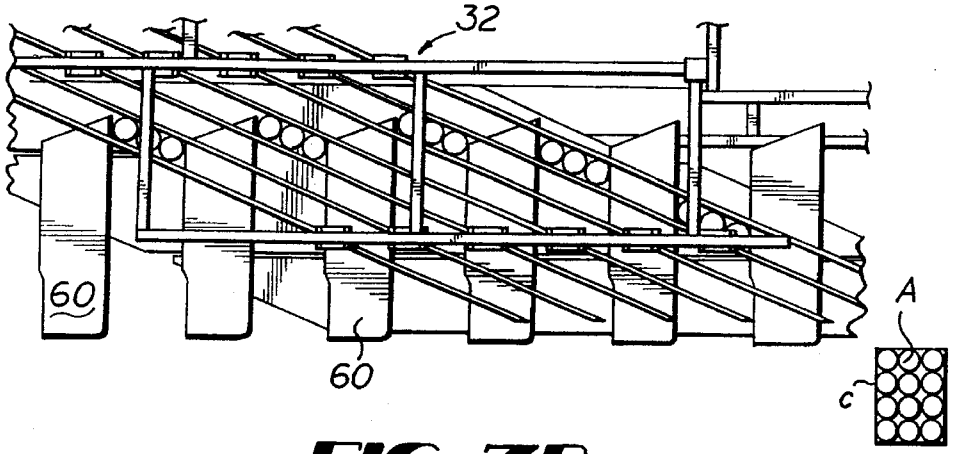
FIGS. 7A, 7B, 7C, and 7D are fragmentary, plan views of different article selector flight arrangements.
Figure 7A:
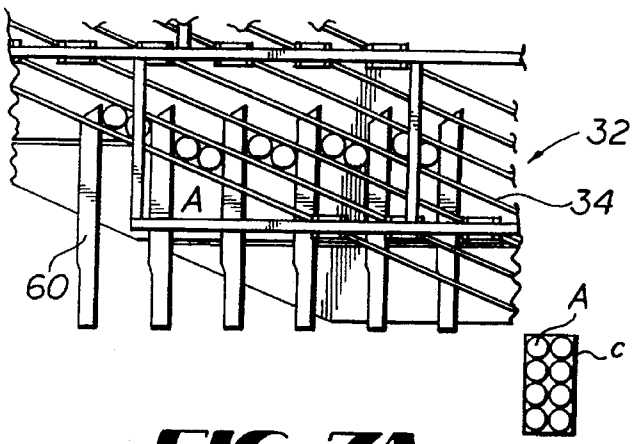

FIGS. 7A–7D depict flights of various geometries or designs and being phase adjusted to various positions to select articles of different product group configurations. In FIG. 7A, the flights 60 are phased to a pitch of six inches and are selecting two columns of articles, or a "two up" configuration having four rows. This selection will result in a container configuration of eight articles as shown in FIG. 7A. FIG. 7B shows a different wedge design on a twelve inch pitch, selecting a "three up" configuration having four rows for a total of twelve articles. FIG. 7B also depicts two lanes being blocked as by lane blocking assemblies (not shown) to prevent articles from entering those lanes. The number of active lanes, or lanes having articles moving to article selector 16, will determine the number of rows of product in a selected product group configuration, while the width of the space or pocket defined between successive flights determines the number of columns.

Figure 7D:
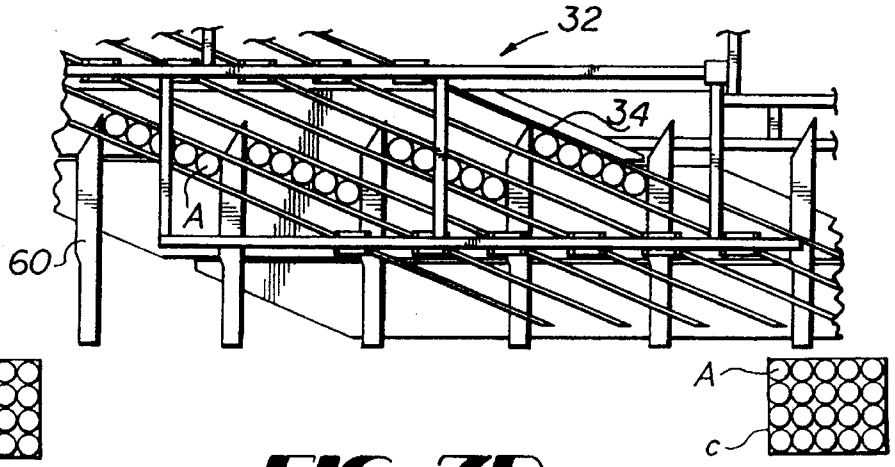
Figure 7C:
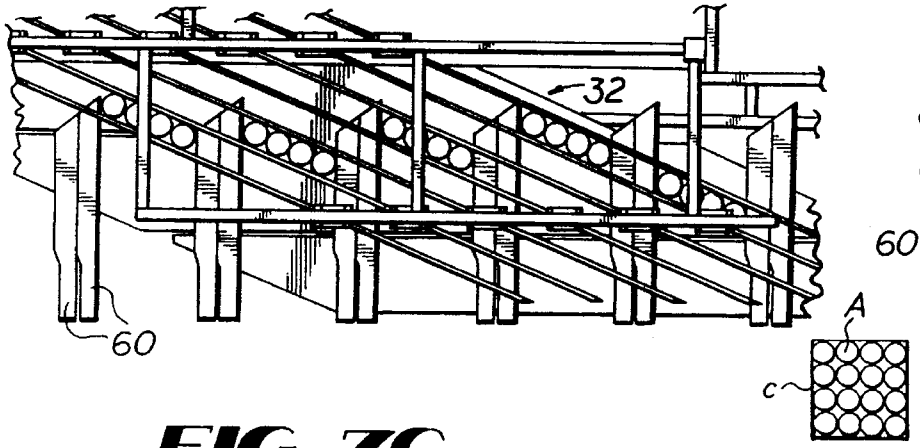
Figure 8:
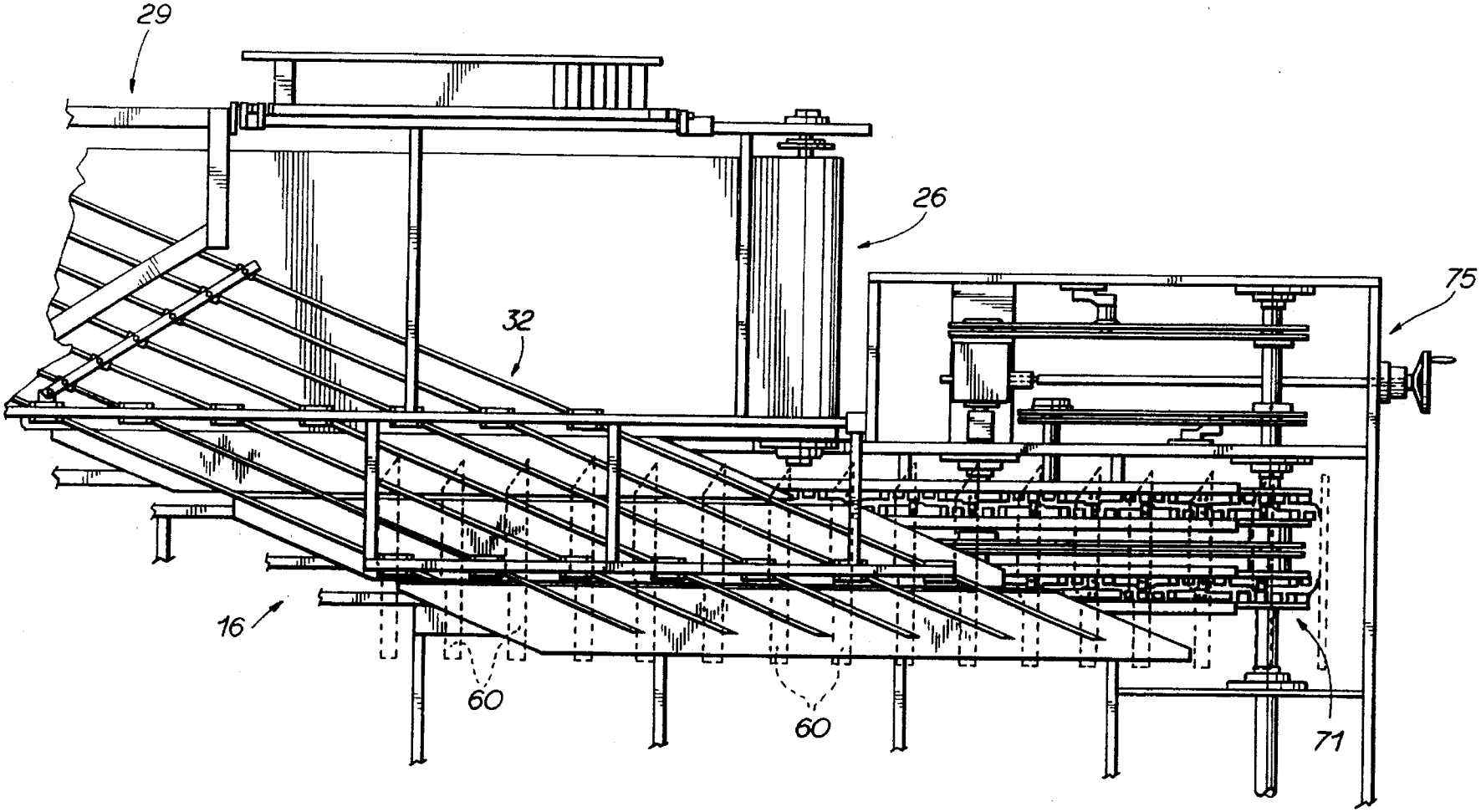
FIG. 8 is a fragmentary, plan view of the article infeed mechanism and of the article selection mechanism.

FIG. 7C is an example of the use of the phase adjustment feature of the article selector 16 to form nested wedges. In FIG. 7C, inner chains 68 and 69 have been phase adjusted so that their associated lugs are positioned directly adjacent to the next lugs of the outer chains 68 and 70. Thus, the flights depicted in FIG. 7C are placed directly side by side in a nesting arrangement. The shape of the combined or nested wedges shown in FIG. 7C has been calculated as being acceptable to select a product group configuration having four columns and four rows of articles.

With the present invention, therefore, it is possible to design a combined, nested wedge shape capable of optimally, or at least acceptably, selecting a principal product diameter, while allowing the nested wedges to be phased apart to acceptably select a secondary product of a different diameter. Optionally in such a flight nesting arrangement, one set of flights, either the flights associated with the inner conveyor chains or the flights associated with the outer conveyor chains, readily can be removed and replaced without having to replace the other flight group, in order to process a secondary article group of a different diameter. FIG. 7D depicts another arrangement selecting a product group of four up or columns having five rows.

Container or carton transport 17 extends longitudinally along and adjacent to article selector 16, and defines a longitudinal path of travel $P_2$ in the elongate dimension of machine 10, substantially from infeed end 11 to outlet end 12. Container transport 17 also comprises a chain conveyor identical to conveyor 66, except that the chain conveyor of carton transport 17 also includes a mechanism to permit the left and right pairs of chains to be moved toward and away from each other by slidable engagement on the drive shaft and idler shaft. The chain conveyor of carton transport 17 also differs in lug type and lug attachment. These types of phase adjustable and width adjustable chain conveyors are well known in the art.

Figure 10C:
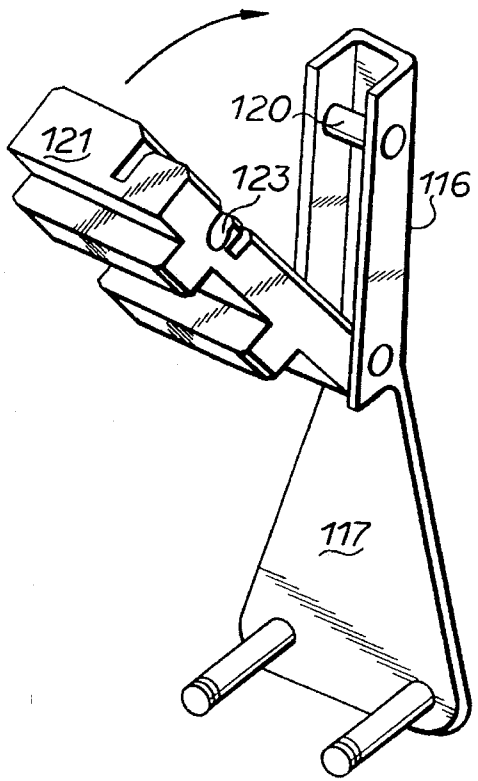
FIGS. 10A, 10B and 10C are exploded perspective views of the loading and trailing lugs and associated fill blocks.
Figure 10B:
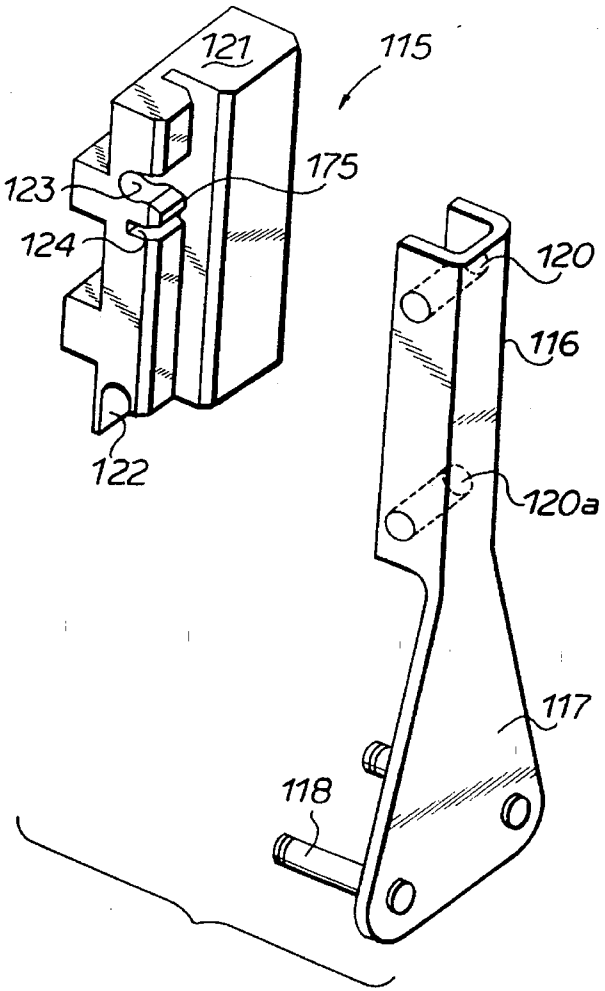
Figure 10A:
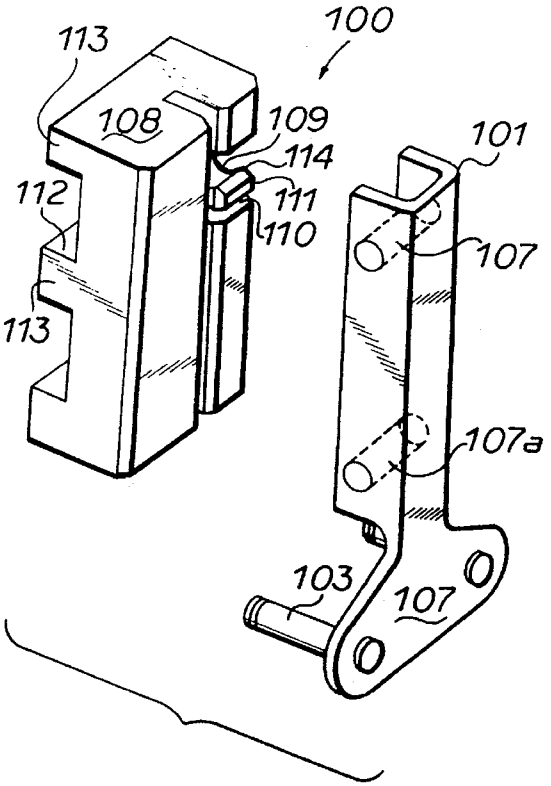

As shown in FIGS. 1 and 2, carton transport 17 includes upstanding, leading and trailing retainer container flights or lugs which define pockets therebetween into which cartons or containers are placed by carton placer 18. FIG. 10A depicts a pushing or trailing lug assembly 100 which is comprised of upstanding U-shaped lug body 101, having a chain mounting bracket 102 formed along its lower end. Pins 103 attach lug 101 to outer chain 105 of container transport chain conveyor 106. Pushing lug 101 also includes horizontally extending upper and lower guide pins 107 and 107*a*. Lug assembly 100 also comprises pushing lug fill block 108. Fill block 108 is adapted to be received into the U-shaped portion of pushing lug 101 by cooperation of a lower mating slot (not shown) with lower pin 107*a* and upper mating slot 109 into upper pin 107. Fill block 108 preferably is made of synthetic material such as plastic or nylon, and is formed to define deflection slot 110 directly below mating slot 109. The diameter of slot 109 is sized so that fill block must be press fit onto upper pin 107, allowing arm 111 defined between slot 109 and slot 110 to deform into slot 110 until pin 107 slips into complete engagement with mating slot 109. A detent 114 retains pin 107 into mating slot 109 until an opposite force is applied to disengage pin 107. In this manner, fill block 108 is releasably engaged to pushing lug 101. Fill block 108 additionally includes horizontally extending channels 112 defined between transversely extending teeth 113. Fill block 108 is adapted to contact container C during the transportation of container C over container transport 17.

Figure 11:
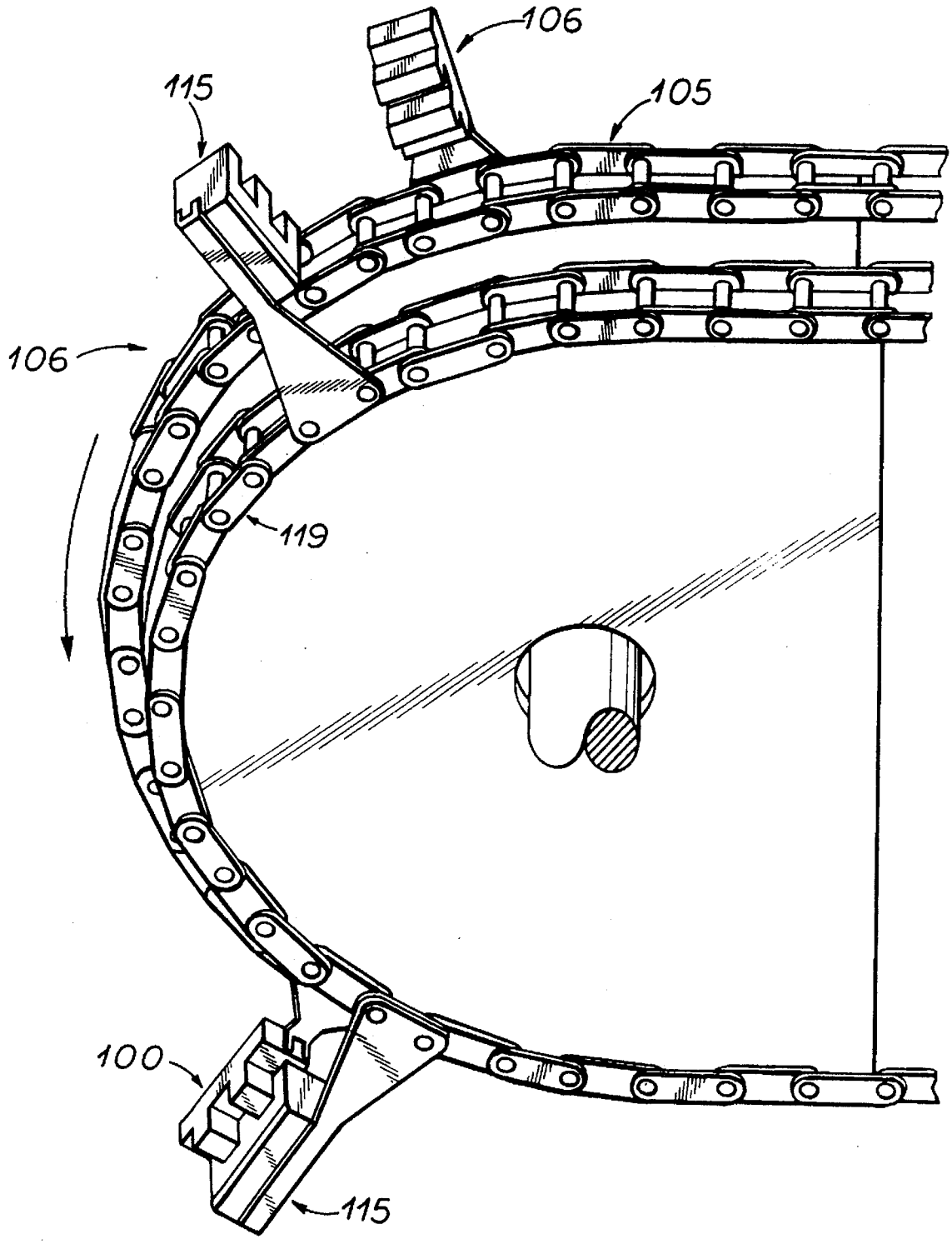
FIG. 11 is a fragmentary, perspective view of a pair of conveyor chains of the carton transport mechanism.

Container transport 17 also includes retaining or leading lug assembly 115. Lug assembly 115 includes upstanding, C-shaped retaining lug 116 forming a triangular bracket 117 at its lower end. Pins 118 attach lug 116 to inner drive chain 119 of chain conveyor 106 as shown in FIG. 11. Lug 116 also includes horizontally extending guide pins 120 and **120*a* which function identically to associated elements 107 and 107*a* on lug 101. Assembly 115 also includes retaining lug fill block 121. Fill block 121 includes lower mating slot 122 adapted to mate with lower guide pin 120*a* and upper mating slot 123 adapted to engage upper guide pin 120. Deflection slot 124 is defined below slot 123 to allow for deflection of arm 125 as guide pin 120 is forced into slot 123. As with fill block 108, the initial width of slot 123 at detent 126 is slightly less than the diameter of pin 120, so that as pin 120 is forced into slot 123, arm 125 is deformed downwardly into slot 124 allowing pin 120 to be fully received within slot 123. This provides an identical anchoring mechanism as discussed above with respect to fill block 108. FIG. 10C depicts the insertion of fill block 121 into lug 116**.

FIG. 11 depicts one pair of the drive chains of conveyor 106, that is, outer chain 105 and inner chain 119. Identically to chain conveyor 66, conveyor 106 includes a second pair of inner and outer drive chains carrying associated lugs (not shown). The outer chains 105 of each conveyor chain pair carries the trailing or pushing lug 101, while the inner chains 119 of each pair of conveyor chains carry leading or retaining lugs 116. FIG. 11 illustrates the takeup or idler end of conveyor 106. As discussed above with respect to conveyor 66, the inner chains 119 are identically phase adjustable with respect to outer chains 105 using chain phasing selector 130, thus allowing lug assemblies 115 to be initially positioned at selected locations with respect to lug assemblies 100. This allows the areas or container pockets between the pushing lugs and the retaining lugs to be selectively varied, thus accommodating containers C of different widths on different product runs. Further, each set of inner and outer chains, that is, an inner and outer chain such as chains 105 and 119, is transversely adjustable toward or away from one another, thus also permitting container C of various depths to be transported on different product runs.

Figure 9A:
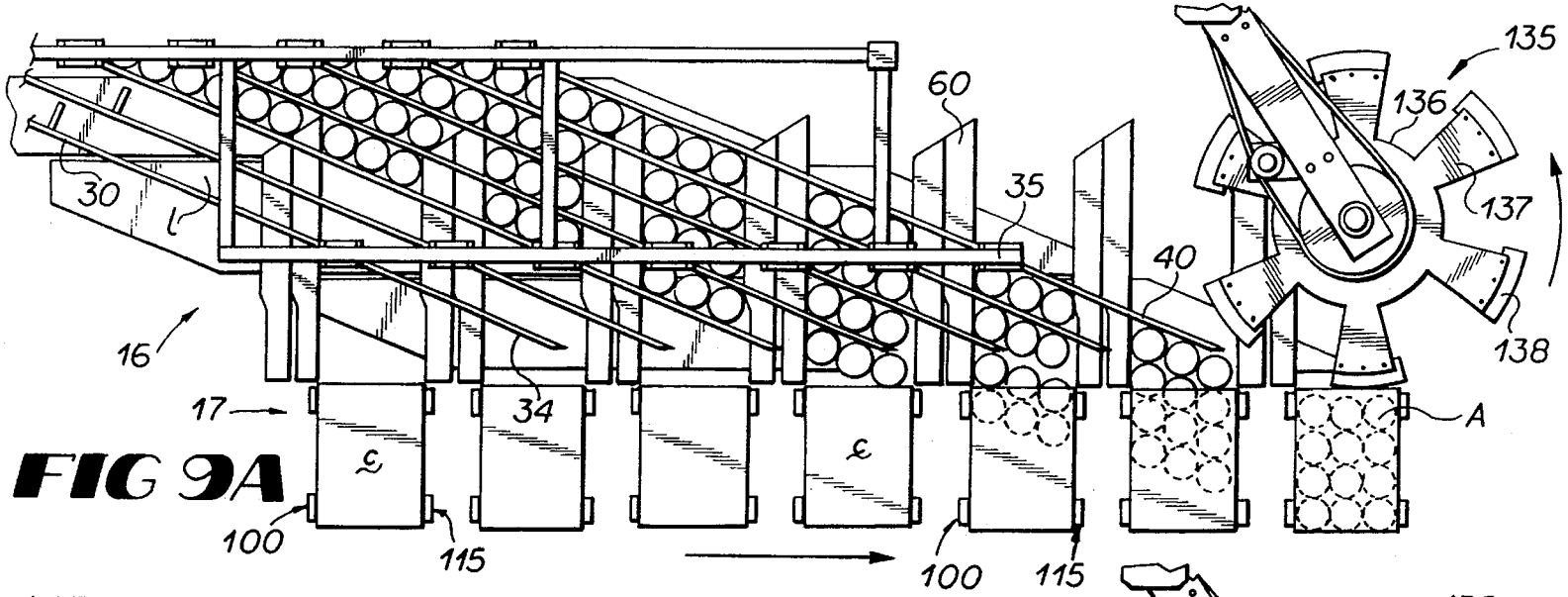
FIGS. 9A and 9B are schematic plan views of the carton transport mechanism in different phased positions.
Figure 9B:
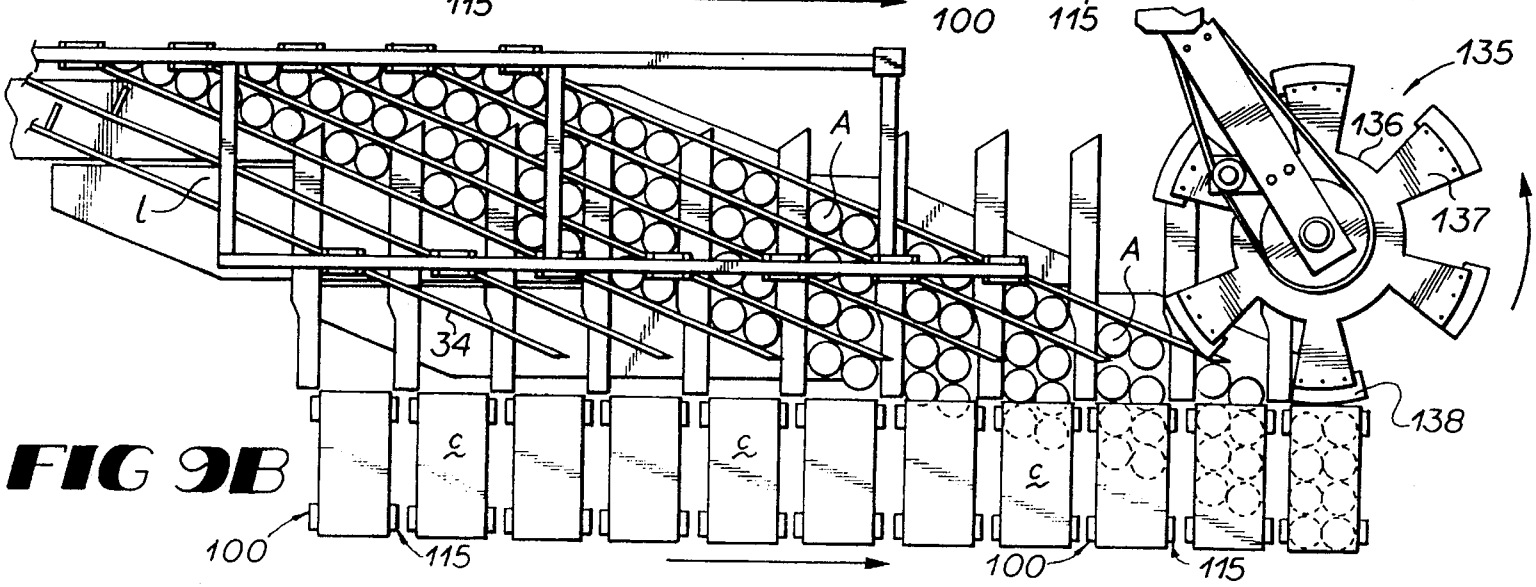

Article selector 17 includes a chain phasing selector 130 operatively connected to chain conveyor 106. Chain phasing selector 130 is identical in structure to selector 75 and operates to selective phase inner drive chains 119. The chain phasing selector 130, for example, can be used to phase adjust the lugs on inner chains 119 in order to split the container pockets or areas between successive pushing and retaining lugs. This makes it possible to double the number of pockets by splitting each pocket in half, and therefore double the number of containers which are filled with articles. For example, FIG. 9A schematically depicts the article selector 16 and article transport 17, both on a twelve inch pitch, processing an article group configuration of "three up" or three columns and four rows, for a twelve pack configuration. The typical linear speed of 250 feet per minute results in an output of 250 packaged containers per minute or 3,000 packaged articles per minute. FIG. 9B depicts the same elements, in which the pushing flight assemblies 100 and the retaining flight assemblies 115 have been phased to be effectively set on a six inch pitch. Thus, each lug functions both as a pushing lug and a retaining lug. The pockets between successive lugs are now sized to accommodate two columns for a "two up" configuration, again having four rows. The container, therefore, has been downsized from a twelve pack to an eight pack container. At the typical linear speed of 250 feet per minute, the same machine will process 500 eight packs per minute or package 4,000 articles per minute. Splitting the carton transport pockets, therefore, can be utilized to increase machine efficiency. As with prior flight-type, continuous motion packaging machines, the pocket defined between leading and trailing container transport lugs must transversely align with the pockets defined between successive selector flights. The respective pockets are in continuous, adjacent, timed synchronization moving along paths $P_1$ and $P_2$, respectively, in the general direction of process flow. Therefore, the selector flights must also be phased to correspond with the phasing of the carton transport lugs, as described above.

Container transport 17 also includes container stabilizing rail 125 which assists in erecting or squaring the containers. The container stabilizing rails 125 are height adjustable to accommodate containers of various heights. A conventional carton placer 18 capable of depositing cartons or containers in timed relationship onto container transport 17 is positioned at the infeed end of the container transport to place and at least partially erect empty, open ended containers or paperboard cartons between successive leading and trailing lugs projecting from conveyor 106 of container transport 17.

As stated, the container transport operates in timed synchronization with article selector 16, and the space created between successive leading and trailing container lugs or flights is equal to the space defined between successive selector flights. Thus, as shown in FIG. 2, an open ended container is placed and positioned adjacent to the article group pocket defined between selector flights, to receive articles from article selector 16.

In operation, articles of a particular height and diameter are fed across infeed guide rail section 33 and into the lanes defined by guide rails 34 of corner guide rail section 31. The articles A are then transported by conveyor 28 through the corner guide rail section, where the articles change direction and are directed at an acute angle toward the longitudinal paths of article selector 16 and container transport 17. The articles are transported through the lanes 1 defined by angled guide rail section 32 toward article selector 16. The selector flights 60 passing under the thinner portion 42 of guide rails 34 are forced between successive articles by the longitudinal movement of the selection end 61, and group a predetermined number of articles between successive selector flights. As the selector flights continue to progress along the path of travel toward the outlet end 12, the articles are forced transversely across the bed plate 4 of the article selector toward containers C, which are transported in timed relationship with the pockets between the flights 60 of the article selector. The action of the force supplied by the selector flights against the articles and the camming action of the angled guide rails causes the articles to be grouped in a predetermined number and then directed into the open end of the containers, as shown in FIG. 2. Optionally another separate rail (not shown) can be positioned across the longitudinal path of the flight selector at the same approximate angle as guide rail section 32, with the separate rail being angled toward the containers on the container transport, so that the articles are directed into the containers. If this embodiment is used, there is no need for the guide rails 34 to extend to be closely adjacent the container transport, as described in the prior embodiment.

A seating assembly 135 is positioned immediately following the article selector. The seating assembly 135 includes a downwardly angled rotatable wheel 136 having outwardly extending arms 137. Attached to each arm is a contact pad 138 which comes in contact with the last article being directed into each container, and pushes or seats that article into the container so that all articles grouped in the container are properly aligned and packed. Preferably, the wheel 136 tilts toward the containers at a ten degree angle, which extends over the tapered end portion 89 of flights 60. Thus the flights can be thicker at selection end 61, which is necessary for selecting articles at high speed, and can be thinner at opposing end 89, to allow arms 137 of seating assembly to turn above ends 89, allowing pads 138 to contact the articles A and properly seat the articles within the containers. Additional assemblies (not shown) close and glue the container flaps to seal the container. The sealed container is then engaged by a compression belt assembly 133 and directed away from the packaging machine 10 by conveyor 134.

If it is desired to process articles having a different diameter, the machine readily can be adjusted as described above to process articles of a different diameter in a different process run. In this event, the corner guide rail section 31 used during the first process run is pivoted out of position and moved across track 53. A substitute corner guide rail section, such as section 31*a*, is moved into position and pivoted over conveyor 28. The adjustable lane guides 34 of angled guide rail section 32 are then adjusted as described above by movement along the longitudinal path of travel to change the widths w of lanes 1 defined between guide rails 34, to accommodate the articles of a different diameter. Selector flights or wedges 60 of an acceptable geometry are installed onto conveyor 66, and properly phase adjusted depending upon the desired product group configuration. Finally, the leading and trailing lugs of container transport 17 are phase adjusted to most efficiently accommodate the particular container, and transversely align the article selector pockets with the carton transport pockets. The inner and outer pairs of drive chains of carton transport 17 are transversely moved with respect to one another to accommodate the container type and depth dimension. It is not important that the adjustment of these elements of the present invention be made in the exact order set forth above. In fact, typically a product size and product configuration first are determined, which dictate the container type and size. This, in turn, determines leading and trailing lug placement. The remaining adjustments are then made considering these criteria. Further, it should be noted that the packaging machine pitch designed into the drive and flight elements of the machine can be selected so as to provide optimum use of the adjustment features of the present invention. This requires merely that consideration be given to the principal product sizes and configurations which will be processed, and the flight selector possibilities which can be accomplished using the article selector phase adjustment described above.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A packaging machine for processing articles along a longitudinal path and for directing the articles into a container, comprising:

(a) article infeed means for arranging said articles in discrete lanes of a first width, said article infeed means being adjustable to accommodate and arrange articles of different diameters;

(b) article selection means disposed adjacent to and cooperating with said article infeed means for selecting a predetermined number of articles from said article infeed means and arranging said predetermined number of articles into an article group;

(c) container transport means disposed adjacent to and functioning in timed relationship with said article selection means for positioning said container to receive articles from said article selection means; and (d) container supply means disposed adjacent to and functioning in timed relationship with said container transport means for supplying containers to said container transport means;

said article infeed means comprising a first guide rail section having spaced parallel guide rails defining said lanes of said first width and said article infeed means being adjustable by sliding said guide rails to define lanes of a second width;

said article infeed means also comprising a second guide rail section having spaced parallel guide rails defining said lanes of said first width and being adjustable by sliding said guide rails to define lanes of said second width, said guide rails in said second guide rail section being at an angle to said guide rails in said first guide rail section;

said packaging machine further comprising a first corner guide rail section having spaced guide rails defining lanes of said second width, said first corner guide rail section being inserted between said first guide rail section and said second guide rail section and mating with said first guide rail section and said second guide rail section when said lanes of said first guide rail section and said second guide rail section are at said second width.

2. The packaging machine of claim 1, said article infeed means also for directing articles in said article group from said article selection means into said container.

3. The packaging machine of claim 2 and a wheel angularly disposed over said article selection means to assist the directing of said articles into said container.

4. The packaging machine of claim 1, and article transfer means disposed adjacent to said article selection means for directing articles in said article group from said article selection means into said container.

5. The packaging machine of claim 1, said article infeed means comprising conveying means spaced below said first guide rail section for moving said articles along said lanes and toward said article selection means.

6. The packaging machine of claim 5, said article infeed means further comprising adjustment means attached to one or more of said guide rails for selectively moving said guide rails with respect to one another for changing the space between said guide rails to thereby change the width of at least one of said lanes.

7. The packaging machine of claim 6, said adjustment means comprising a track disposed adjacent to said guide rails and bearing means connecting said guide rails to said track for allowing the selective movement of said guide rails in relation to said track.

8. The packaging machine of claim 7, said track extending in parallel alignment with said longitudinal path, and said guide rails positioned at an angle to said track.

9. The packaging machine of claim 5, said first guide rail section having an inlet end and an outlet end, and wherein each of said spaced guide rails of said corner guide rail section is constructed and arranged so that said at least a portion of each said spaced guide rail is in parallel alignment with said longitudinal path.

10. The packaging machine of claim 9, said spaced guide rails of said corner guide rail section being fixed in position with respect to one another.

11. The packaging machine of claim 5, and anchor means for locking said guide rails in spaced relationship to one another.

12. The packaging machine of claim 1, said article selection means comprising a first conveyor extending along said longitudinal path, article selector flights carried by said first conveyor at various positions for movement therewith, said article selector flights arranged in spaced relationship to define article group pockets between successive article selector flights.

13. The packaging machine of claim 12, said article selector flights comprising elongate bars extending substantially across said conveyor transversely to said longitudinal path, said article infeed means and said article selection means intersecting to permit said article selector flights to force a predetermined number of articles from said article infeed means and into an article group pocket.

14. The packaging machine of claim 12 and first conveyor phasing means operatively connected to said first conveyor for selectively changing the position of at least part of said article selector flights along said first conveyor.

15. The packaging machine of claim 14, said article selection means comprising two article selector flights nested together at each respective position of said article selector flights along said conveyor, said nested article selector flights being in cooperative engagement to select a predetermined number of articles from said article infeed means.

16. The packaging machine of claim 1, said container transport means comprising a second conveyor extending along said longitudinal path, lugs attached to and projecting outwardly from said second conveyor and fill blocks received in said lugs.

17. The packaging machine of claim 16, said lugs being arranged in pairs spaced transversely with respect to said longitudinal path, and also spaced at various longitudinal positions on said second conveyor to define container pockets between successive pairs of lugs.

18. The packaging machine of claim 17, and second conveyor phasing means operatively connected to said second conveyor for selectively changing the position of at least part of said lugs along said second conveyor.

19. The packaging machine of claim 1, said article selection means comprising a first conveyor extending along said longitudinal path, article selector flights carried by said first conveyor for movement therewith, anchor means carried by and projecting outwardly from said first conveyor for supporting said article selector flights, said article selector flights including attachment means for releasably attaching said article selector flights to said anchor means.

20. The packaging machine of claim 19, said anchor means comprising a pin having an enlarged end portion, and said attachment means comprising a channel defined by said article selection means, said pin adapted to be received into said channel for releasably engaging said article selector flight to said anchor means.

21. The packaging machine as set forth in claim 1, further comprising a beam extending across said guide rails and wherein said guide rails are connected to said beam through linear bearings to permit said guide rails to slide along said beam.

22. The packaging machine of claim 1, further comprising releasable locking means having a first state in which said guide rails are fixed in place and a second state in which said guide rails are free to slide to said second width.

23. The packaging machine of claim 22, wherein said releasable locking means releasably engages said guide rails at only one location on each of said guide rails.

24. The packaging machine of claim 1, further comprising a second corner guide rail section having lanes of a third width, wherein said second corner guide rail section mates with said two straight guide rail section when said lanes are at said third width.

25. The packaging machine of claim 24, wherein when one of said first corner guide rail section or said second corner guide rail section is mating with said guide rail section, the other of said first corner guide rail section or said second corner guide rail section is supported on a frame of said packaging machine.

26. A packaging machine for processing articles along a longitudinal path and for directing the articles into a container, comprising:

(a) article infeed means for arranging said articles in discrete lanes of a first width, said article infeed means being adjustable to accommodate and arrange articles of different diameters;

(b) article selection means disposed adjacent to and cooperating with said article infeed means for selecting a predetermined number of articles from said article infeed means and arranging said predetermined number of articles into an article group;

(c) container transport means disposed adjacent to and functioning in timed relationship with said article selection means for positioning said container to receive articles from said article selection means; and (d) container supply means disposed adjacent to and functioning in timed relationship with said container transport means for supplying containers to said container transport means;

said article infeed means comprising a first guide rail section having spaced parallel guide rails defining said lanes of said first width and said article infeed means being adjustable by sliding said guide rails to define lanes of a second width;

said article infeed means also comprising article flow control means for interrupting the movement of said articles along said lanes and toward said article selection means wherein positions of said article flow control means are adjusted with said sliding of said guide rails.

27. The packaging machine of claim 26, said article flow control means being attached to said spaced, parallel guide rails.

28. The packaging machine of claim 27, said article flow control means comprising an actuator mounted to at least one of said spaced parallel guide rails, a pivot shaft attached to said actuator, and an abutment means attached to said pivot shaft.

29. A packaging machine for inserting articles into containers, said packaging machine comprising:

a first infeed conveyor;

guide rails disposed over said first infect conveyor, said guide rails being spaced apart from one another to define infeed lanes, said guide rails defining a first rail section having an inlet end and an outlet end;

a second conveyor disposed along a longitudinal axis and positioned adjacent said first infeed conveyor, flight retaining fasteners attached to and carried by said second conveyor, transversely extending selector flights mounted to said second conveyor in successive relationship, fastening means on said selector flights for releasably attaching said selector flights to said flight retaining fasteners, said selector flights being spaced apart from one another to define pockets between successive flights; and a third conveyor positioned adjacent said second conveyor and synchronized in timed relationship with said second conveyor;

wherein said fastening means is incorporated into said selector flights;

and wherein said selector flights have a width ww equal to:

$$ww = P - \cos\alpha \left[ (u-1)d + 2\left( \frac{d/2}{\cos\alpha} \right) \right] - C_1,$$

wherein P is a machine pitch, u is a number of articles between successive selector flights, d is an article diameter, $\alpha$ is an angle between said guide rails and said longitudinal axis, and $C_1$ is a clearance distance.

30. A packaging machine for inserting articles into containers, said packaging machine comprising:

a first infeed conveyor;

guide rail, disposed over said first infeed conveyor, said guide rails being spaced apart from one another to define infeed lanes, said guide rails defining a first rail section having an inlet end and an outlet end;

a second conveyor disposed along a longitudinal axis and positioned adjacent said first infeed conveyor, flight retaining fasteners attached to and carried by said second conveyor, transversely extending selector flights mounted to said second conveyor in successive relationship, fastening means on said selector flights for releasably attaching said selector flights to said flight retaining fasteners, said selector flights being spaced apart to define pockets between successive flights; and a third conveyor positioned adjacent to said second conveyor and synchronized in timed relationship with said second conveyor;

wherein said fastening means is incorporated into said selector flights;

and wherein said selector flights have a height h equal to:

$$h = (U-1)d\sin\alpha + \frac{\left( \frac{d/2}{\cos\alpha} \right) - (d/2)}{\tan\alpha},$$

where U is a number of articles between successive selector flights, d is an article diameter, and $\alpha$ is an angle between said guide rails and said longitudinal axis.

* * * * *